US009598849B2

(12) United States Patent
Halloran et al.

(10) Patent No.: US 9,598,849 B2
(45) Date of Patent: Mar. 21, 2017

(54) TOILET INSTALLATION SYSTEM AND METHOD

(71) Applicant: Kohler Co., Kohler, WI (US)

(72) Inventors: Daniel N. Halloran, Saukville, WI (US); Randy O. Mesun, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 14/624,303

(22) Filed: Feb. 17, 2015

(65) Prior Publication Data

US 2015/0159359 A1 Jun. 11, 2015

Related U.S. Application Data

(62) Division of application No. 13/475,670, filed on May 18, 2012, now Pat. No. 8,978,170.

(60) Provisional application No. 61/488,608, filed on May 20, 2011.

(51) Int. Cl.
*E03D 11/16* (2006.01)

(52) U.S. Cl.
CPC ..... *E03D 11/16* (2013.01); *Y10T 29/49826* (2015.01)

(58) Field of Classification Search
CPC ..... E03D 11/13; E03D 11/135; E03D 11/16; E03D 11/143
USPC ..... 4/252.1; 285/56, 58
See application file for complete search history.

(56) References Cited

U.S. PATENT DOCUMENTS

| | | | |
|---|---|---|---|
| 167,702 A | 9/1875 | Smith | |
| 519,878 A | 5/1894 | Stevens, Jr. | |
| 928,523 A | 7/1909 | Kelly | |
| 1,334,880 A | 3/1920 | Auslander | |
| 2,517,411 A | 8/1950 | Patterson | |
| 2,681,780 A | 6/1954 | Santoro | |

(Continued)

FOREIGN PATENT DOCUMENTS

| | | | |
|---|---|---|---|
| AT | 319858 | 1/1975 | |
| CH | 443169 A * | 8/1967 | ..... E03D 11/16 |

(Continued)

OTHER PUBLICATIONS

International Search Report and Written Opinion for International Application No. PCT/US2012/038652, date of mailing Sep. 26, 2012, 7 pages.

(Continued)

*Primary Examiner* — Erin Deery
(74) *Attorney, Agent, or Firm* — Foley & Lardner LLP

(57) ABSTRACT

A method for installing a skirted toilet having a pedestal and a bowl, the method comprising securing a trap to a soil pipe, the trap having a base and a passageway configured to be fluidly connected between the bowl of the toilet and the soil pipe, wherein the base comprises a clamping member pivotally coupled thereto; positioning the pedestal over the trap to fluidly couple the bowl to the trap such that an opening in a wall of the pedestal is substantially aligned with an opening in the clamping member; and securing the toilet to the trap by inserting an adjusting member through the opening of the pedestal and into the opening of the clamping member and rotating the adjusting member to pivot the clamping member into engagement with the adjusting member.

19 Claims, 19 Drawing Sheets

(56) References Cited

U.S. PATENT DOCUMENTS

| | | | | |
|---|---|---|---|---|
| 2,689,701 | A | 9/1954 | Whitaker | |
| 3,026,075 | A | 3/1962 | Phelon et al. | |
| 3,148,379 | A | 9/1964 | Müller | |
| 3,334,362 | A | 8/1967 | Müller | |
| 3,486,204 | A | 12/1969 | Hurtner et al. | |
| 3,680,154 | A | 8/1972 | Stairs | |
| 3,693,918 | A * | 9/1972 | Fisher | A47G 33/1206 248/524 |
| 3,896,510 | A * | 7/1975 | O'Connell | E03D 11/16 285/56 |
| 4,007,901 | A | 2/1977 | Mancini et al. | |
| 4,913,395 | A | 4/1990 | Juhas | |
| 5,743,508 | A | 4/1998 | Fiveash | |
| 5,984,248 | A | 11/1999 | Evans et al. | |
| 6,292,956 | B1 * | 9/2001 | Kayahara | B28B 1/261 4/420 |
| 7,165,275 | B2 | 1/2007 | Clark | |
| 7,984,884 | B1 | 7/2011 | Iliev | |
| 8,037,637 | B2 | 10/2011 | Odom, Jr. | |
| 2002/0084397 | A1 | 7/2002 | Ross, Jr. | |
| 2003/0145429 | A1 | 8/2003 | Twomey | |
| 2010/0175176 | A1 | 7/2010 | Ollila | |

FOREIGN PATENT DOCUMENTS

| | | |
|---|---|---|
| CN | 1628204 | 6/2005 |
| CN | 2828172 | 10/2006 |
| DE | 2117777 A1 | 10/1972 |
| EP | 345610 | 12/1989 |
| EP | 504587 | 9/1992 |
| GB | 1074887 A | 7/1967 |
| JP | H09119166 | 5/1997 |
| LU | 42232 A1 | 10/1962 |

OTHER PUBLICATIONS

First Office Action in related Chinese Application No. 201280002248.0 dated Nov. 20, 2013, 18 pages.

* cited by examiner

TOILET INSTALLATION SYSTEM AND METHOD

CROSS-REFERENCE TO RELATED PATENT APPLICATIONS

This application is a Divisional of U.S. patent application Ser. No. 13/475,670, filed May 18, 2012, which claims the benefit of and priority to U.S. Provisional Patent Application No. 61/488,608, filed on May 20, 2011. Both aforementioned U.S. patent applications are hereby incorporated by reference herein in their entireties.

BACKGROUND

The present application relates generally to the field of toilets. More specifically, the present application relates to improved systems and methods for installing a toilet (e.g., coupling the toilet to a trap assembly and/or mounting the toilet to the floor).

There is an increasing demand from consumers for toilets having bases or pedestals with smooth exterior surfaces, in part due to their improved aesthetics and cleanability. These toilets with smooth exterior surfaces may include pedestal side walls (or portions thereof) that are spaced a distance outward from the internal trapway of the toilet (hereinafter referred to as "skirted toilets"). In other words, the skirted feature of the toilet is created by the pedestal having a wall with a smooth exterior surface for aesthetic purposes and an interior surface that is separated by a gap (e.g., open space) from the external surfaces of the passageway (e.g., trap passageway). Many conventional non-skirted toilets have pedestals that include externally visible fasteners, indentations or voids (e.g., voids that outline the functional features, such as the trapway, contained within the toilet to transfer the water and waste), and other features that it may be desirable to eliminate for aesthetic and other purposes.

One challenge associated with skirted toilets relates to the manner in which such toilets must be mounted or coupled to the trap assembly and/or to the floor to prevent rotating, twisting, or rocking of the toilet during the user experience. For conventional toilets, a typical mounting method involves inserting a fastener through a horizontal portion (e.g., flange) of the toilet base or pedestal directly into the closet flange, the soil pipe, and/or the floor (i.e., the fastener is arranged perpendicular to the surface of the floor). In skirted toilets, however, such a configuration may not be appropriate or desirable because of the design of the skirted portion (e.g., there may not be a surface of the skirt that is parallel to the floor that would allow a fastener to be driven directly through the toilet and into the closet flange and/or the floor). It would be advantageous to provide a simple and secure method and system for mounting or coupling a skirted toilet to the trap, soil pipe, and/or the floor without having functional issues (e.g., leaking) and/or aesthetic issues (e.g., large openings requiring additional vitreous plastic covers or patches).

Additionally, there is a need to provide a more secure coupling between the toilet and the closet flange and/or the soil pipe, in order to improve the stability of the toilet, such as during use of the toilet, as well as, to reduce the likelihood of leaking, such as between the toilet and the drain pipe (or soil pipe or sanitary sewer system). Current skirted toilet couplings (or installation mountings) only provide either a horizontal force or a vertical force, but not both, to secure the toilet to the soil pipe. It would be advantageous to be able to couple the toilet to the soil pipe in a manner that provides both horizontal and vertical clamping forces to more securely couple the toilet and to reduce the likelihood of leaking, while simultaneously minimizing the aesthetic impact of the coupling (or fastening) system.

SUMMARY

One embodiment relates to a mounting assembly for securing a pedestal of a toilet to a trap. The mounting assembly including a clamping member pivotally coupled to the trap, the clamping member having an opening extending therethrough, and an adjusting member extending through an opening in the pedestal and through the opening in the clamping member. The adjusting member is configured to pivot the clamping member between a first position in which a portion of the clamping member contacts the adjusting member to secure the pedestal to the trap and a second position in which the portion of the clamping member does not contact the adjusting member.

The mounting assembly may also include a pivot member pivotally coupled to the clamping member, wherein the pivot member may be configured to be coupled to the adjusting member. Accordingly, adjustment of the adjusting member may be configured to pivot the clamping member by moving the pivot member relative to the adjusting member. The pivot member may also include threads configured to engage mating threads of the adjusting member, such that rotation of the adjusting member in a first direction moves the clamping member toward the first position and rotation of the adjusting member in a second direction moves the clamping member toward the second position.

The mounting assembly may also include a pin configured to pivotally couple the clamping member to the trap. The pin may include a body and a shoulder to contact the trap to limit a travel of the pin relative to the trap, wherein the body is configured to pivot in an opening in the trap. The clamping member may also include a second opening configured to receive the pin to pivotally couple the clamping member to the trap. The clamping member may also include a cavity configured to retain the pivot member while allowing for relative rotation between the clamping member and pivot member.

Another embodiment relates to a toilet including a pedestal having a wall, a trap having a passageway in fluid communication with the bowl and a base configured to be coupled to a soil pipe, and a mounting assembly for coupling the pedestal to the trap. The mounting assembly may include a clamping member pivotally coupled to the trap about a pivot axis, the clamping member having an opening extending therethrough, and an adjusting member provided in the opening and configured to be engaged by the clamping member and the wall of the pedestal. The adjusting member is configured to pivot the clamping member into and out of engagement with the adjusting member, and when the clamping member engages the adjusting member, the pedestal is secured to the trap.

When the clamping member engages the adjusting member, a wall of the opening of the clamping member may contact the adjusting member along at least a portion of the length of the adjusting member. The wall of the pedestal may include a side wall portion and a rear wall portion, wherein the side wall portion extends to the rear wall having a substantially smooth contour. The mounting assembly may be a first mounting assembly and the toilet may further include a second mounting assembly for coupling the pedestal to the trap, wherein the second mounting assembly may be configured substantially the same as the first mounting assembly, wherein the first and second mounting assemblies provided on opposite sides of the trap and configured to engage opposite side walls of the pedestal.

Yet another embodiment relates to a method for installing a skirted toilet having a pedestal and a bowl. The method includes: i. securing a trap to a soil pipe, the trap having a base and a passageway configured to be fluidly connected between the bowl of the toilet and the soil pipe, wherein the base comprises a clamping member pivotally coupled thereto; ii. positioning the pedestal over the trap to fluidly couple the bowl to the trap such that an opening in a wall of the pedestal is substantially aligned with an opening in the clamping member; and iii. securing the toilet to the trap by inserting an adjusting member through the opening of the pedestal and into the opening of the clamping member and rotating the adjusting member to pivot the clamping member into engagement with the adjusting member.

The clamping member may include a pivot member having threads configured to engage mating threads of the adjusting member, such that rotation of the adjusting member in a first direction pivots the clamping member to engage the adjusting member and rotation of the adjusting member in a second direction pivots the clamping member to disengage the adjusting member.

DETAILED DESCRIPTION

With general reference to the Figures, disclosed herein are toilets configured having a coupling or mounting assembly for securing a pedestal of the toilet to a trap, which may be attached to a soil pipe or drain pipe. The mounting assemblies as disclosed herein may include a clamping member and an adjusting member. The clamping member may be pivotally coupled to the trap and may include an opening extending through the clamping member. The adjusting member may be provided in the opening of the clamping member and may be configured to be engaged by the clamping member and the pedestal, such as a wall of the pedestal. The adjusting member may be configured to pivot the clamping member into and out of engagement with the adjusting member, such as to secure and unsecure the pedestal from the trap, respectively. The mounting assemblies as disclosed herein may advantageously be configured to secure the pedestal of the toilet from inside the pedestal (e.g., inside the wall forming the pedestal) with just a portion of the adjusting member being visible. The mounting assemblies as disclosed herein may also advantageously be configured to apply clamping forces in more than one direction, such as, for example, in both the horizontal and vertical directions, to more securely couple the pedestal to the trap and thereby to the floor.

Figure 1:
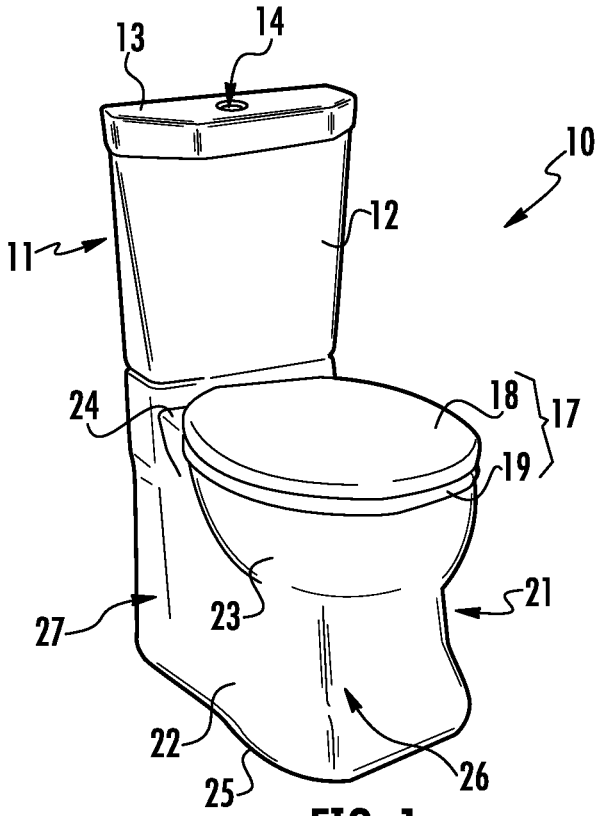
FIG. 1 is a perspective view of a toilet having a fully skirted pedestal or base.

FIG. 1 illustrates an exemplary embodiment of a skirted toilet 10 that includes a tank 11, a pedestal 21 (or base), a seat assembly 17 and a coupling or mounting assembly (not shown). The tank 11 may include a hollow bowl 12 for storing the water used during operational (or flushing) cycles, a lid (or cover) 13 for providing selective access into the bowl 12, and an actuator 14 that is configured to initiate an operational cycle when activated. The actuator 14 may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapways and other features) may vary from the embodiments shown and described herein, and that the embodiments disclosed herein are not intended as limitations. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The installation (e.g., mounting, coupling) systems and methods described herein may be used with a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening (not shown) configured to receive water from a coupled water supply (not shown), such as from a hose (e.g., line, tube). The tank 11 may also include an inlet valve assembly (not shown) or other device configured to control the flow of water from the water supply into the tank through the inlet opening. Within the tank 11 may be provided a float device (not shown) for controlling the inlet valve assembly, such as by opening the valve to refill the bowl 12 of the tank 11 after an operational cycle and closing the valve when the water in the bowl 12 reaches a preset volume or height. The tank 11 may also include an outlet opening (not shown) configured to transfer (e.g., conduct) the water stored in the bowl 12 of the tank to the pedestal 21 (e.g., the bowl) upon activation of the actuator 14. The tank 11 may include an outlet valve assembly (not shown) or other device configured to control the flow of water from the tank into the pedestal 21 through the outlet opening.

The pedestal 21 (or base) of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the bowl 12 of the tank 11. The top member 24 may include an inlet opening (not shown) that may be aligned with the outlet opening of the tank 11, such as when the tank 11 is coupled to (or resting above) the pedestal 21, wherein water is selectively transferred (e.g., conducted) from the tank 11 through the outlet opening of the tank to the pedestal 21 through the inlet opening of the pedestal 21, when the toilet is activated through the actuator 14. The outlet valve assembly may control the flow of water from the tank to the pedestal. The toilet may also include a gasket or seal (not shown) that is provided between the tank 11 and the pedestal 21 to prohibit leaking. For example, a gasket may be provided between the outlet opening of the tank and the inlet opening of the pedestal to prohibit leaking between the tank and the pedestal.

The plateau formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a passageway (not shown), such as a passageway, that fluidly connects the outlet opening of the bowl 23 to an exiting device (e.g., a trap or a soil pipe). The passageway generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as to the trap.

Between operational cycles of the toilet 10, the water (and waste) is collected in the first portion of the passageway (in addition to the receptacle of the bowl), such that the weir prohibits the water from passing past the weir and into the second portion of the passageway. Upon activation of the actuator 14, additional water is discharged from the tank 11 into the bowl 23 of the pedestal 21, resulting in the flushing action and waste removal through the soil pipe.

The seat assembly 17 may include a cover member 18 (e.g., lid), a seat member 19 (e.g., ring member), and a hinge (not shown). The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first down lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

Figure 2:
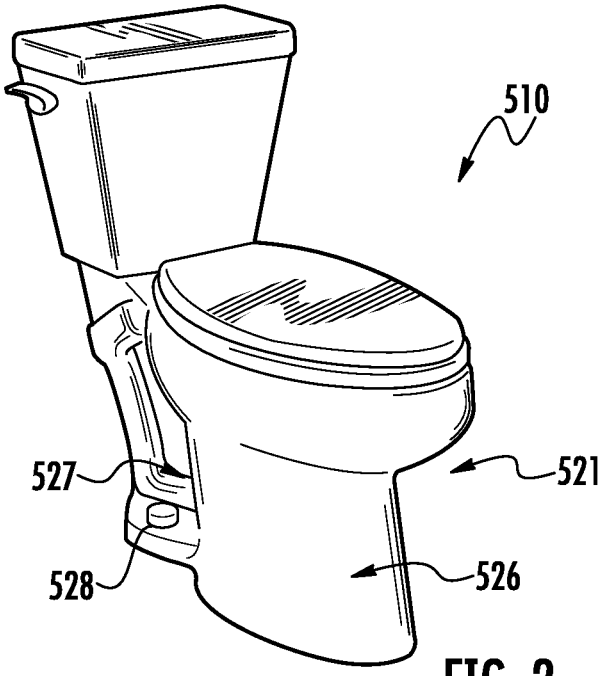
FIG. 2 is a perspective view of a toilet having a non-skirted pedestal.

In contrast to the skirted toilet shown in FIG. 1, a non-skirted toilet is illustrated generally in FIG. 2. The pedestal 521 of the non-skirted toilet 510 is generally configured with a smooth contour in the forward portion 526 (i.e., directly below the bowl down to the base), however, the rearward portion 527 of the pedestal is configured with an irregular (or non-harmonious) contour that includes one or more large voids or indentations that typically follow the contour of the trapway passage. The non-skirted toilet 510 generally is coupled to the soil pipe (and/or the floor of the washroom) using bolts that are covered by covers 528. The irregular contour of the rearward portion 527, as well as the covers 528, may not be desirable in certain applications (e.g., where different aesthetics are desired by the consumer and/or installer). Additionally, the irregular contours of the non-skirted toilets are more difficult to clean relative to the smooth and harmonious contour of the skirted toilets.

As shown in FIG. 1, the pedestal 21 of the toilet 10 includes a full skirt, wherein the side walls 22 of the pedestal 21 extend generally from below and behind the bowl 23 rearward to the rear wall (e.g., back surface) of the pedestal 21 with a smooth contour. Thus, the pedestal 21 of the fully skirted toilet 10 includes both a forward portion 26 and a rearward portion 27 configured to have a relatively smooth (or harmonious) contour, which is minimally interrupted by indentations or voids. For example, the pedestal 21 of the toilet 10 may include substantially smooth side walls 22 from the front portion to the rear portion. It should be noted that a skirted toilet may not have a completely smooth (or harmonious) pedestal and the exemplary embodiments shown and described herein are not meant as limitations.

Figure 3:
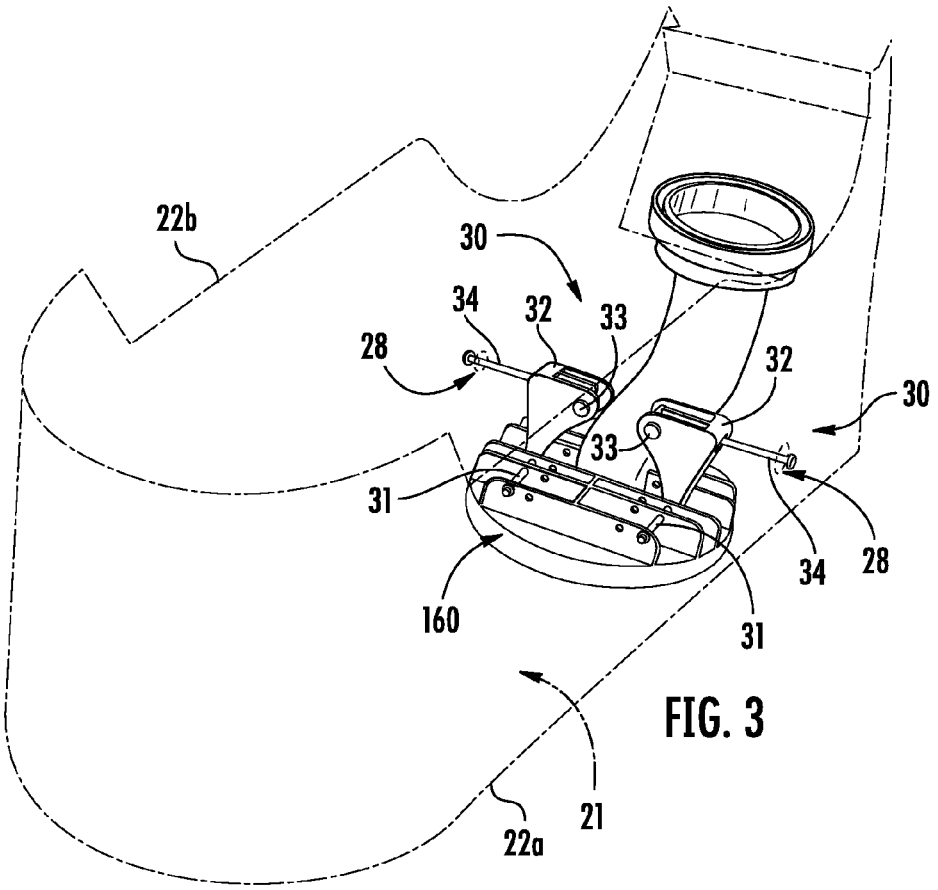
FIG. 3 is a perspective view of a pedestal or base for a toilet, illustrating a coupling or mounting assembly for securing the pedestal to a trap and/or the floor.
Figure 4:
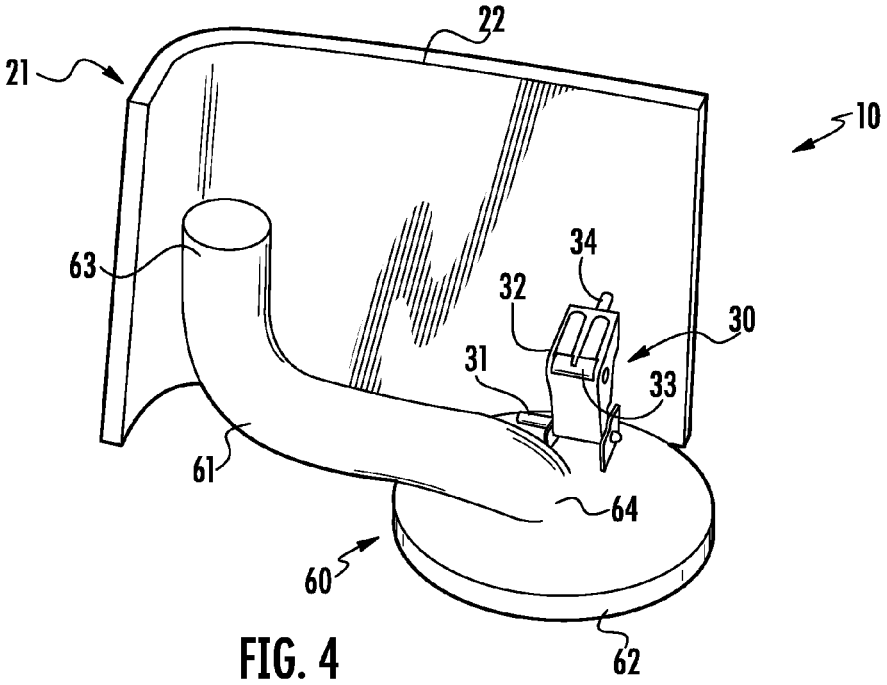
FIG. 4 is a side perspective view of an exemplary embodiment of a coupling or mounting assembly shown coupling the pedestal of the toilet to a trap.
Figure 5:
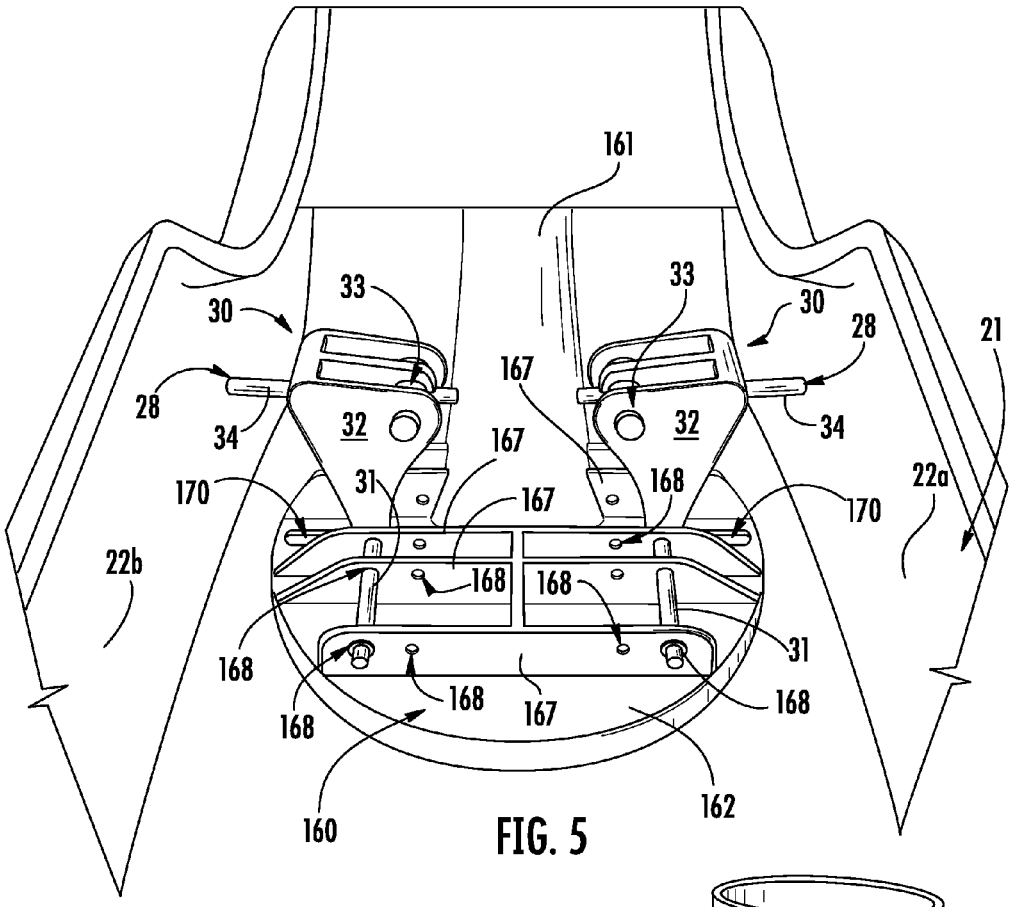
FIG. 5 is a front perspective view of the coupling or mounting assembly of FIG. 4 shown coupling the pedestal of the toilet to another trap.

FIGS. 3-5 illustrate an exemplary embodiment of an installation or mounting assembly 30 (referred to below as a "coupling assembly") configured for securing a pedestal or base of a skirted toilet in place in a desired location. For ease of description, the following text will refer to the components of the toilet shown in FIG. 1, although it should be understood that similar concepts will apply to most any toilet having particular value for skirted toilets. According to an exemplary embodiment, the toilet 10 may include two coupling assemblies 30, wherein the first coupling assembly 30 is configured to couple the right wall 22*a* of the pedestal 21 to a trap 60 (or to a mounting structure separate from the trap 60) and the second coupling assembly 30 is configured to couple the left wall 22*b* of the pedestal 21 to the trap 60 (or to a mounting structure separate from the trap 60). According to other exemplary embodiments, the toilet may be configured to include only one coupling assembly or a plurality of coupling assemblies.

Figure 6:
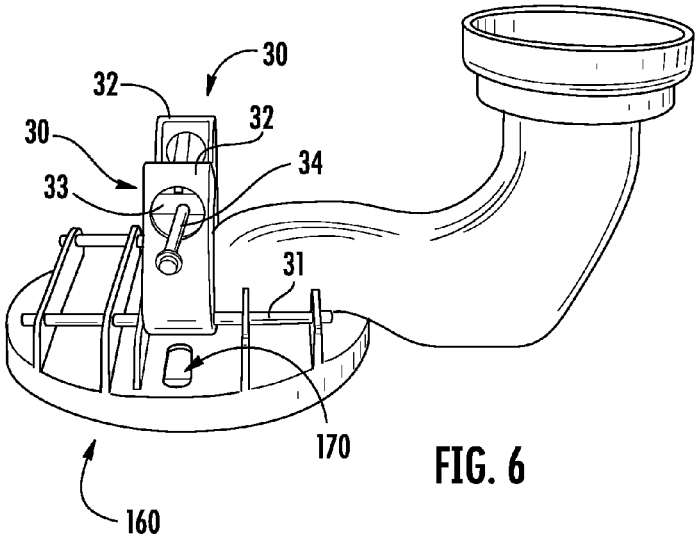
FIG. 6 is a side view of the coupling assembly of FIG. 4 shown coupled to a trap.

The coupling assembly 30 is uniquely configured to provide horizontal and vertical loading (e.g., clamping) to secure the toilet 10, such as by securing the pedestal 21 of the toilet 10 to the trap 60, which may be fixedly coupled to the soil pipe and/or the floor of the washroom. The method of achieving the horizontal and vertical forces (e.g., loading) to secure the toilet is discussed in greater detail below. FIG. 6 illustrates the two coupling assemblies 30 coupled only to the trap 60 and not coupled to the pedestal.

The trap 60 may be made from a polymer or a composite material through a molding (e.g., injection molding) process, may be made from a metal (e.g., steel, cast iron, etc.) through a casting or other forming process, or may be made from any suitable material through any suitable process as may be appropriate or desired for a given application. According to the exemplary embodiment shown in FIG. 4, the trap 60 includes a trap passageway 61 that extends from a base 62. The trap passageway 61 may be a hollow portion (e.g., tube) having a first end 63 and a second end 64. The first end 63 of the trap passageway 61 may be configured to be coupled to the toilet, such as to the internal pedestal passageway, to connect (e.g., fluidly, structurally) the passageway and the trap passageway. The second end 64 of the trap passageway 61 may be configured to be coupled to the soil pipe, which may be provided in the floor or wall, to connect (e.g., fluidly, structurally) the trap passageway to the building soil (or drain) pipe. Thus, water and waste may pass from the passageway through the trap to the soil pipe when the toilet is activated. It should be noted that the toilets as described and shown herein may include a single passageway or may include more than one passageways coupled together (e.g., a trap passageway coupled to an internal pedestal passageway) to transfer the water and waste from the bowl of the pedestal to the soil pipe. Thus, trap passageway and internal pedestal passageway may be separate members of the toilet or may be different portions of an integrally formed passageway.

The base 62 of the trap 60 may be circular shaped and may surround a portion of the second end 64 of the trap passageway 61. The base 62 may be configured to be coupled to the gasket (e.g., wax ring), the soil pipe and/or to the floor of the washroom, such as through conventional fasteners (e.g., bolts, screws, etc.). The base 62 may also be configured to be coupled to the coupling assembly 30, as discussed in more detail below, to secure (e.g., couple) the toilet to the soil pipe and/or the floor of the washroom through the trap 60. According to other exemplary embodiments, the base and other features of the trap may have different configurations (e.g., the base may be non-circular).

FIGS. 9-14 illustrate an exemplary embodiment of the coupling assembly 30 that is configured to secure the toilet in place, such as by providing horizontal and vertical loading to couple the wall 22 of the pedestal 21 to the trap 60. The coupling assembly 30 may include a pin 31, a clamping member 32 (e.g., linking member), a pivot member 33, and an adjusting member 34 (e.g., a fastener such as a bolt having a threaded portion). The pin 31 may couple the clamping member 32 to the trap 60, such that the clamping member 32 may pivot or rotate about the pin 31 relative to the trap 60. The pivot member 33 may be coupled to the clamping member 32, such that the pivot member 33 may pivot or rotate relative to the clamping member 32. The pivot member 33 may also be configured to receive the adjusting member 34, wherein the adjusting member 34 may be configured to adjust the position of the clamping member 32 to thereby increase or decrease the loading (e.g., horizontal loading, vertical loading) provided by the coupling assembly 30.

Figure 10:
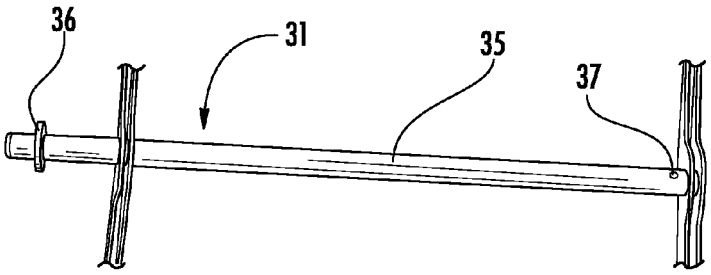
FIG. 10 is a perspective view of an exemplary embodiment of a pin configured for use in a coupling or mounting assembly, such as the coupling assembly shown in FIG. 9.

According to the exemplary embodiment shown in FIG. 10, the pin 31 may be a cylindrically shaped pin made from a metal (e.g., steel, brass, stainless steel), a polymer, a composite, or any suitable material that is strong enough to withstand the stresses induced by loads induced by the coupling assembly 30. The pin 31 may include a body 35, a shoulder 36, and an opening 37. The shoulder 36 may be provided on one end of the body 35 and may be configured having a larger diameter relative to the diameter of the body 35, wherein the shoulder 36 may be configured to contact a feature of the trap 60 to limit the travel of the pin 31 relative to the trap 60. The opening 37 of the pin 31 may be provided on the other end of the body 35 and may be configured to receive a device (e.g., pin, cotter pin, etc.) in order to limit the travel of the pin 31 in the direction opposite to the direction that the shoulder limits travel. According to other embodiments, the pin 31 may be configured as a bolt, screw, rivet, or any suitable device that may couple two objects together and allow for the first object (e.g., clamping member) to rotate relative to the second object (e.g., trap).

Figure 11:
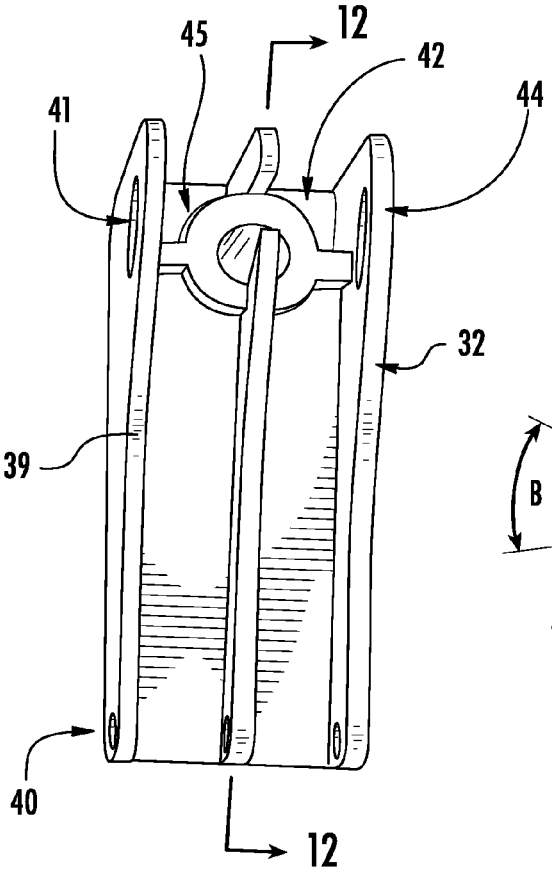
FIG. 11 is a perspective view of an exemplary embodiment of a clamping member configured for use in a coupling or mounting assembly, such as the coupling assembly shown in FIG. 9.
Figure 12:
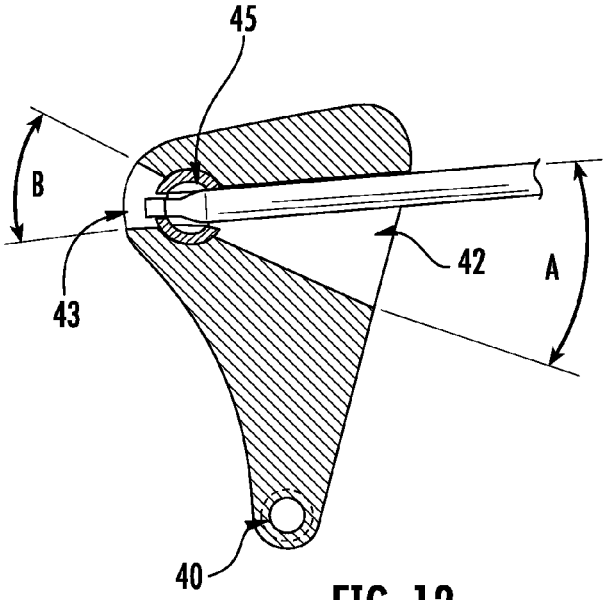
FIG. 12 is a cross-sectional view of the clamping member of FIG. 11 taken along line 12-12, shown with an adjusting member engaging a pivot member.

According to the exemplary embodiment shown in FIGS. 11 and 12, the clamping member 32 may be made from a polymer, a composite material, a metal (e.g., brass, stainless steel), or any suitable material that is strong enough to withstand the stresses induced by loads generated by the coupling assembly 30 in order to secure the toilet, as well as loads resulting from actual toilet use. According to an exemplary embodiment, the clamping member is made from a polymeric material and includes features (e.g., ribs) for providing enhanced rigidity and/or strength for the clamping member.

The clamping member 32 may include a body 39 that has a generally triangular cross-section (with rounded corners and one or more non-straight sides), with the legs of the triangular shape being longer than the base of the triangular shape, wherein the legs point downwardly and the base is above the legs. The clamping member may also include a base and two side walls, wherein each side wall has a polygonal or other cross-section that extends from the base. It should be noted that the clamping member may be configured to have any shape suitable for withstanding the stresses and/or for transferring the horizontal and vertical forces that result during coupling the toilet and securing the toilet during subsequent use of the toilet. Thus, the embodiments of the clamping members disclosed herein are not intended to serve as limitations.

The clamping member 32 may include a first opening 40 (e.g., aperture, hole, etc.), a second opening 41 (e.g., aperture, hole, etc.), and a third opening 42 (e.g., aperture, hole, etc.). The first opening 40 may be provided near the lower point of the triangular shaped body 39 (i.e., where the legs intersect) and may extend through the width of the body 39 to provide a pivot axis for the clamping member 32 to pivot about. The first opening 40 may be configured to be round to receive the pin 31, such as the body 35 of the pin 31, wherein that the clamping member 32 may rotate or pivot about the pin 31 and about the axis defined by the first opening 40. The second opening 41 may be provided near one of the upper points of the triangular body 39 (i.e., where one of the legs intersects the base) and may extend through the width of the body 39. The second opening 41 may be configured to be round to receive the pivot member 33, wherein the pivot member 33 may rotate or pivot relative to the clamping member 32 about the axis formed by the pivot member and second opening 41 of the clamping member. The clamping member 32 may also include a cavity 45 configured to retain the pivot member 33 from moving linearly relative to the clamping member 32, while allowing rotation of the pivot member 33 relative to the clamping member 32. The cavity 45 may be defined by the second opening 41, such as by being an extension of the second opening 41, may be a bore configured adjacent to the second opening 41, or may have any other suitable configuration.

The third opening 42 of the clamping member 32 may extend through the upper portion of the body 39 in a direction transverse to the first and second openings 40, 41. According to an exemplary embodiment, the third opening 42 is configured to be cone shaped (as shown in FIG. 12). The surface of the cone shaped third opening 42 may extend approximately from the axis of the second opening 41 in two directions at an angle A (as shown in FIG. 12) relative to each other, such that the third opening 42 becomes increasingly larger at locations along the opening that are farther from the axis of the second opening 41. The third opening 42 is configured to receive the adjusting member 34 of the coupling assembly 30, in order for the threaded portion 51 of the adjusting member 34 to be easily inserted into the threaded portion 47. Also, when the adjusting member 34 is adjusted, the clamping member 32 may be configured to move (or pivot) about the first opening 40, to change the alignment of the adjusting member 34 within the third opening 42 to thereby change the clamping forces or loads (e.g., horizontal clamping loads, vertical clamping loads). This function (e.g., adjustable loading) is discussed in more detail below.

According to other exemplary embodiments, the third opening 42 may be configured to have any other shape, such as being curved (e.g., concave, convex) or irregular. Also, the surface or surfaces that define the shape of the third opening 42 may include a cam or a cam surface (i.e., an eccentric surface having a center axis that is offset from the pivot axis of the cam), wherein the cam surface may be configured to influence the forces or loads (e.g., vertical load, horizontal load), such as when the adjusting member is adjusted. For example, a cam surface may protrude beyond the conical surface defining the third opening 42 (i.e., the cam surface may extend into the opening defined by the otherwise conical surface) to impart forces into the adjusting member to secure the toilet in place. It should be noted that the geometric configuration of the cam may be varied to tailor the forces securing the toilet in place.

The clamping member 32 may also include a fourth opening 43 that extends through the upper portion of the body 39 away from the third opening 42 (and transverse to the first and second openings 40, 41). The fourth opening 43 may be cone shaped, curved, or may have any suitable shape. For example, the sides of the cone shaped fourth opening 43 may extend approximately from the axis of the second opening 41 in two directions at an angle B (as shown in FIG. 12) relative to each other, such that the fourth opening 43 becomes increasingly larger at locations along the opening that are farther from the axis of the second opening 41. The fourth opening 43 may be configured to receive a portion of the adjusting member 34, such as the end of the adjusting member 34 that passes through the pivot member 33 when the adjusting member is adjusted. In other words, the shape of the fourth opening 43 may be configured to allow the adjusting member 34 to pass through the pivot member 33 and to allow for the change in alignment between the adjusting member 34 and the clamping member 32 when the adjusting member 34 is adjusted.

Figure 13:
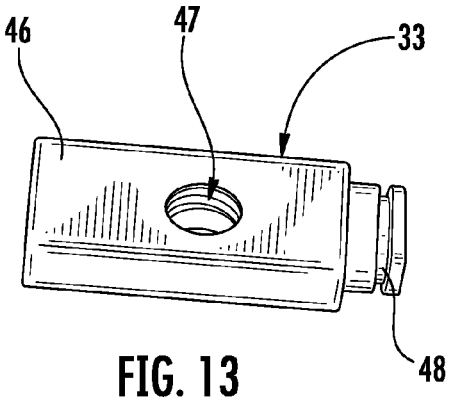
FIG. 13 is an exemplary embodiment of an pivot member configured for use in a coupling or mounting assembly, such as the coupling assembly shown in FIG. 9.

According to the exemplary embodiment shown in FIG. 13, the pivot member 33 includes a body 46 and a threaded portion 47 (e.g., threaded insert). The pivot member 33 may be configured to transfer load (e.g., forces), provide a controlled rotation and retain the adjusting member 34. The body 46 may be cylindrically shaped to provide a bearing surface for the pivot member 33 to pivot (or rotate) relative to the clamping member 32, and the body 46 may be made from a polymer, a composite material, a metal (e.g., brass, stainless steel), or any suitable material that is strong enough to withstand the stresses induced by loads generated by the coupling assembly and allows for efficient relative rotation.

The threaded portion 47 may include threads provided along an inner diameter that are configured to be engaged by mating threads from the adjusting member 34 to provide adjustable coupling between the pivot member 33 and the adjusting member 34 in order to tailor the clamping loads (e.g., horizontal clamping loads, vertical clamping loads). The threaded portion 47 of the pivot member 33 may be made from a metal (e.g., brass, stainless steel), a polymer, a composite, or any suitable material that is strong enough to withstand the stresses induced by loads generated by the coupling assembly. According to an exemplary embodiment, the pivot member 33 includes the body 46 made from a polymer overmolded (or co-molded) onto the threaded portion 47 that is made from brass. This configuration allows for efficient rotation of the pivot member 33 by having a body 46 with a relative low coefficient of friction and provides strength and durability by having a threaded portion 47 with relative high mechanical properties (e.g., yield strength, tensile strength, etc.).

The pivot member 33 may be configured so that the body 46 fits into the second opening 41 of the clamping member 32. The clamping member 32 may have a retaining feature that is configured to retain the pivot member 33 in position while allowing rotation of the pivot member 33 relative to the clamping member 32. The clamping member 32 may also include a fifth opening 44 that is concentric with the second opening 41, but provided on the opposite side of the clamping member 32 to thereby provide two bearing surfaces about which the pivot member 33 may rotate (or pivot) relative to the clamping member 32. Alternatively, the pivot member 33 may also include a shoulder 48 that extends from one side of the body 46, wherein the shoulder 48 may be configured to have a smaller diameter relative to the diameter of the body 46. The shoulder 48 may be configured to be inserted into the fifth opening 44 of the clamping member 32, which may be configured to have a smaller diameter relative to the diameter of the second opening 41. This configuration allows the pivot member 33 to rotate (or pivot) relative to the clamping member 32 on two bearing surfaces and also retains the lateral position of the pivot member 33 relative to the clamping member 32.

The pivot member 33 may also include an aligning feature that is configured to properly align the threaded insert such that when the adjusting member 34 is inserted through the wall of the pedestal, the threads of the adjusting member 34 find or locate the threads of the insert of the pivot member 33 in order to adjustably couple the adjusting member 34 to the clamping member 32. For example, the shoulder 48 of the pivot member 33 may be configured to have a D-shape as the aligning feature. The fifth opening 44 of the clamping member 32 may be configured as a D-shape with a similar diameter (with clearance to allow for relative rotation), but with the flat of the D positioned farther away from the center of the circular portion (relative to the flat of the D on the shoulder 48) to allow a predetermined degree of rotation in each direction (e.g., clockwise, counterclockwise) of the pivot member 33 relative to the clamping member 32. Alternatively, the fifth opening 44 of the clamping member 32 may include a semi-circular portion that is interrupted by a V-shape portion, which allows the D-shape shoulder 48 to rotate a predetermined amount of angular rotation. Thus, the aligning feature may be configured to allow the pivot member 33 to rotate (within the clamping member 32) the full angular travel represented by angle A formed by the third opening 42 of the clamping member 32 to provide adjustable clamping, but to prevent the pivot member 33 from rotating beyond the third opening 42 to make installation easier.

The threaded portion 51 of the adjusting member 34 may also include a lead-in or any suitable feature that ensures the proper alignment of the threads of the threaded portion 51 with the threads of the threaded portion 47 of the pivot member 33 to prevent cross-threading when the adjusting member 34 is threaded into the pivot member 33. As shown in FIG. 12, the lead-in may be a shoulder portion having an outer diameter that is smaller than the diameter of the threaded portion 51 of the adjusting member 34. The lead-in may vary in length and/or diameter.

Figure 14:
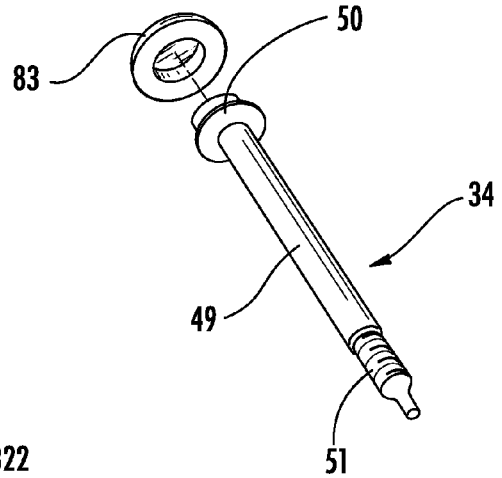
FIG. 14 is a perspective view of an exemplary embodiment of an adjusting member configured for use in a coupling or mounting assembly, such as the coupling assembly shown in FIG. 9.

As shown in FIG. 14, the adjusting member 34 may be cylindrically shaped and may be made from a metal (e.g., brass, stainless steel), a polymer, a composite, or any suitable material that is strong enough to withstand the stresses induced by loads generated by the coupling assembly. According to an exemplary embodiment, the adjusting member 34 is configured as a fastener (e.g., bolt, screw, etc.) having a body 49 and a head 50. The body 49 may be configured to have a threaded portion 51, which may begin on the end opposite the head 50 and may extend along the full length of the body 49 or may extend any length less than the full length of the body 49. The head 50 may include an outer shape (e.g., hexagonal) and/or an inner shape (e.g., hexagonal bore, star slot, Philips or cross slot, flat slot) that are configured to allow a user to input torque through a device (e.g., screwdriver) to turn (or rotate) the adjusting member 34 in order to provide adjustability of the coupling assembly 30. The threaded portion 51 may be configured to have a matching (or mating) thread size (e.g., pitch, diameter) relative to that of the threaded portion 47 of the pivot member 33. The threaded portion 51 may also have a lead to make starting the threads easier.

The toilets 10, 110 may be assembled in place in the washroom using a four step method. The first step includes positioning the seal (e.g., wax ring) and the trap relative to the drain pipe (or soil pipe) and/or the floor of the washroom. The trap 160 may be coupled to the soil pipe with the wax ring (or alternate sealing material or alternate seal device) provided therebetween to form a seal to prohibit leaking. For example, the base of the trap may include one or more openings (e.g., apertures, holes, slots), wherein each opening in the trap is configured to receive a fastener (e.g., bolt, screw, etc.) to clamp the trap to the floor and/or the soil pipe. According to an exemplary embodiment, the base 162 of the trap 160 includes two openings 170 one opening 170 provided on each side of the base 162 (i.e., one opening 170 on each side of the trap passageway 161) to provide a secure coupling of the trap to the soil pipe and/or the floor of the washroom.

The second step includes coupling (e.g., attaching) the coupling assembly 30 to the trap 160. As shown in FIG. 5, the trap 160 may include walls (e.g., ribs) 167 extending upwardly from the top surface of the base 162, wherein the walls 167 include openings (e.g., apertures, holes, etc.) 168 configured to receive the pin 31 of the coupling assembly 30. Two of the walls 167 may be offset a distance to allow the clamping member 32 to fit between the walls 167, such that the clamping member 32 may pivot or rotate relative to the trap 160. The clamping member 32 of the coupling assembly 30 may be positioned within the walls 167 of the trap 160 such that the openings 168 are substantially concentric with the first opening 40 in the clamping member 32. The pin 31 may be inserted through the openings 168 in the walls 167 of the trap 160, as well as through the first opening 40 of the clamping member 32, to pivotally couple the clamping member 32 to the trap 160. The pin 31 may be inserted until the shoulder 36 contacts a wall 167 (or other stop feature) of the trap, then the pin 31 may be retained in position, such as by inserting a cotter pin (or other securing device) through the opening 37 in the pin 31. It should be noted that the position of the coupling assemblies, such as relative to the trap, may be adjusted (e.g., forward, backward, outside, inside) to accommodate varying parameters (e.g., trap sizes, pedestal widths), which is discussed in more detail below.

The pivot member 33 may be preassembled to the clamping member 32. For example, the pivot member 33 may be pivotally coupled to the clamping member 32 during manufacturing, such that the person installing the toilet does not need to couple the pivot member and the clamping member. Alternatively, the second step may include assembling the pivot member 33 to the clamping member 32, if the pivot member 33 is not preassembled to the clamping member 32. The body 46 of the pivot member 33 may be inserted through the second opening 41 and into the cavity 45 of the clamping member 32, wherein the pivot member 33 may be retained therein, yet free to rotate in the cavity 45 relative to the clamping member 32. The threads of the threaded portion 47 of the pivot member 33 may also be oriented (e.g., aligned) to face in the direction toward the third opening 42 of the clamping member 32 to allow access to the threads of the threaded portion 47 by the threads of the adjusting member 34. For example, the aligning feature discussed above may ensure proper orientation or alignment of the pivot member 33 relative to the clamping member 32. This configuration allows for the person coupling the toilet to the soil pipe and/or the floor, to properly thread (e.g., without cross-threading) the adjusting member 34 into the pivot member 33 with ease, even though this may be a blind coupling (i.e., having little or no visual access of the threads of the threaded portion 47 of the pivot member 33, since they are obscured by the adjusting member and/or the pedestal).

It should be noted that the coupling assembly may include more than one clamping member, such as shown in FIG. 5. For such an embodiment of the coupling assembly, step two may be repeated according to the number of clamping members to thereby pivotally couple each clamping member to the trap.

The coupling assembly 30 may also be configured to retain the clamping member 32 in a position, such as the in the upright position shown in FIG. 12 for installation to thereby make assembly of the toilet easier. The clamping member 32 may be retained in such a position using a relative small force, which provides support to the clamping member 32 when the adjusting member 34 is threaded into the pivot member 33. However, the forces generated by the adjustment of the adjusting member 34 (following the initial threading of the adjusting member 34 to the pivot member 33) will overcome the small retaining force to allow the clamping member 32 to pivot about the first opening 40 to properly secure the toilet in place. According to an exemplary embodiment, the coupling assembly 30 may include a spring or biasing member or retaining feature to impart a force to position the clamping member 32 in an upright position, wherein the rotational travel of the clamping member 32 (e.g., in the direction away from the adjacent wall of the pedestal) may be limited to prevent the clamping member 32 from over-rotating beyond the upright position. For example, the clamping member 32 may include a recess that receives a portion (e.g., an end) of a steel spring to provide a biasing force to retain the clamping member 32 in place under low loads (e.g., forces). Following threading of the adjusting member to the pivot member, the force from the biasing member may be overcome by the adjustment of the adjusting member, wherein adjustment of the adjusting member (in the clamping direction) pivots (or rotates) the clamping member (also in the clamping direction).

The third step includes locating the toilet 10, 110 (in particular, its associated pedestal) in place over the trap 60, 160. The third step may also include connecting (e.g., fluidly, structurally) the passageway of the pedestal to the trap passageway 61 of the trap 60, if necessary. For example, the pedestal 21 may be located or positioned over the coupled trap 60 and coupling assembly 30 (e.g., the clamping member, pin, and pivot member), such that that the openings 28 in the wall 22 of the pedestal 21 are aligned with the clamping member 32, such as the third opening 42 of the clamping member. Additionally, if needed, the trap passageway and the passageway may be fluidly (and/or structurally) coupled, such as through an elastomeric seal or other suitable coupling, wherein the water (and waste) may pass from the passageway of the pedestal to the trap passageway of the trap.

Figure 7:
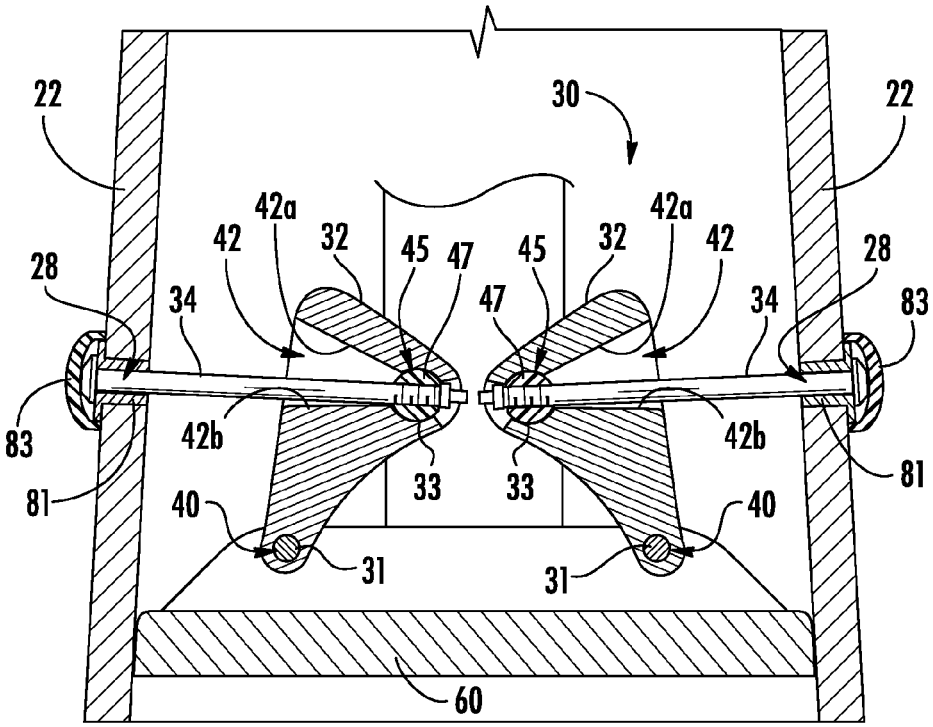
FIG. 7 is a sectional view illustrating the coupling or mounting assembly of FIG. 5 in an unclamped or unlocked position.

The fourth step includes securing the toilet 10 to the trap 60 and/or the soil pipe, through the coupling assembly 30, such as by adjusting the adjusting member 34. With the openings 28 in the wall 22 of the pedestal 21 being aligned with the clamping member 32 (e.g., the third opening 42), one adjusting member 34 may be inserted through each opening 28 in the wall 22 (e.g., right wall 22*a*, left wall 22*b*) to engage the threaded portion 51 of the adjusting member 34 with the threaded portion 47 of the pivot member 33. As shown in FIG. 7, the adjusting member 34 may access the threaded portion 47 through the third opening 42 of the clamping member 32. As the adjusting member 34 is adjusted to provide clamping, such as by rotating the adjusting member in the tightening or clamping direction (e.g., clockwise), the threads of the adjusting member 34 thread along the threads of the threaded portion 47 of the pivot member 33. Because the pivot member 33 is retained by the cavity 45 of the clamping member 32 and the adjusting member 34 is retained by the wall 22 of the pedestal 21, the adjustment of the adjusting member 34 in the clamping direction pulls the threaded portion 47 toward the inside surface of the wall 22 of the pedestal and thereby induces the clamping member 32 to rotate (or pivot) about the first opening 40, such that the upper portion of the clamping member 32 (e.g., second opening 41) moves toward the inside surface of the wall 22 of the pedestal 21. In other words, as the adjusting member 34 is rotated in the clamping (e.g., clockwise) direction, the clamping member rotates about the first opening 40 to change the alignment or orientation of the adjusting member 34 relative to the third opening 42 of the clamping member 32, such as by bringing the adjusting member 34 closer to the top surface 42*a* of the third opening 42 and farther away from the bottom surface 42*b* of the third opening 42.

Figure 8:
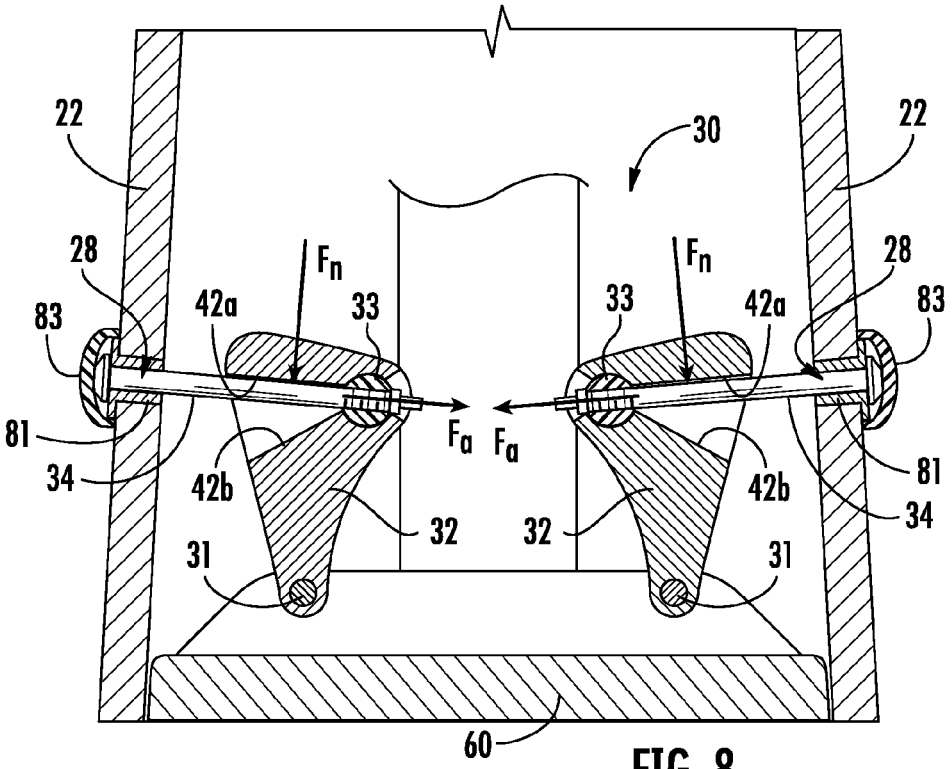
FIG. 8 is a sectional view illustrating the coupling or mounting assembly of FIG. 5 in a clamped or locked position.
Figure 9:
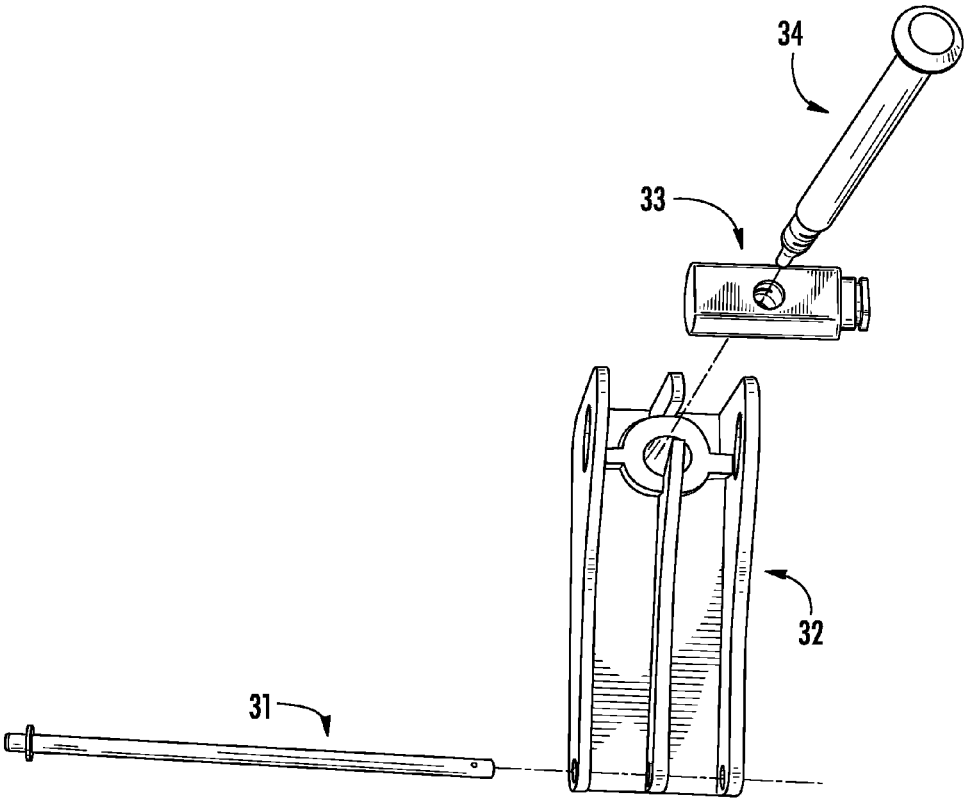
FIG. 9 is a perspective exploded view of an exemplary embodiment of a coupling or mounting assembly for a toilet.

As shown in FIG. 8, after a certain amount of adjustment (e.g., rotation) of the adjusting member 34 in the clamping (e.g., clockwise) direction, at least a portion of the top surface 42*a* of the third opening 42 comes into contact with at least a portion of the adjusting member 34 to thereby impart a normal force Fn into the adjusting member 34. The normal force Fn puts the adjusting member 34 into bending, similar to a simply supported beam. The normal force Fn may include a horizontal component force and a vertical component force to provide clamping forces in both the horizontal and vertical directions. For example, the orientation (e.g., alignment) of the adjusting member relative to horizontal may be varied in order to vary the horizontal and vertical components of the normal force Fn.

Also, once the clamping member 32 (e.g., top surface 42*a* of the third opening 42) is contacting the adjusting member 34, further rotation of the clamping member 32 is prevented (except to remove tolerances, elastic bending or flexing, plastic bending or flexing etc.). Accordingly, additional adjustment of the adjusting member 34 in the clamping direction (after such contact between the clamping member 32 and adjusting member 34) puts the adjusting member 34 in tension (under an increasing tensile load that is a function of the adjustment), which imparts an axial force Fa into the adjusting member 34. The axial force Fa may also include a horizontal component force and a vertical component force to provide clamping forces in both the horizontal and vertical directions, depending on the alignment or orientation of the adjusting member relative to horizontal. The axial force Fa may be adjusted (e.g., by rotating the adjusting member 34) to increase (or decrease) the clamping pressure (e.g., horizontal clamping pressure) that the adjusting member 34 imparts on the wall 22 of the pedestal 21 of the toilet 10. Thus, the clamping pressure securing the toilet (e.g., the pedestal) may be varied by adjusting the adjusting member. In other words, the more the adjusting member is rotated in the clamping (e.g., clockwise) direction, the higher the resulting forces in the horizontal and vertical directions (from the normal force Fn and the axial force Fa) to clamp or secure the toilet (e.g., the pedestal) to the trap, soil pipe, and/or the floor of the washroom.

It should be noted that the geometry of the coupling assembly may vary in order to influence the forces Fa and Fn, which influences the horizontal and vertical forces securing the toilet in place. For example, the relative positions of the first opening 40, second opening 41 and/or third opening 42 of the clamping member 32 may be configured differently (e.g., spaced farther apart, spaced closer together, or a combination thereof) than as shown in the embodiments disclosed herein, in order to influence the forces Fa and Fn. Additionally, other geometric relationships may be changed to influence the forces Fa and Fn, and other geometric relationships may be changed to influence other performance parameters of the coupling assemblies disclosed herein.

The amount of adjustment necessary for the clamping member of the coupling assembly to rotate from an unclamped (or non-locked) position, such as shown in FIG. 7 to a clamped (or locked) position, such as shown in FIG. 8, may vary or may be tailored. For example, the amount of adjustment may vary due to the tolerances in the toilet (e.g., pedestal, coupling assembly, trap, etc.), as well as the tolerances in the soil pipe. As another example, the amount of adjustment may be tailored to accommodate different configurations, such as different configurations of the pedestal and/or trap. Additionally, the coupling assembly (e.g., clamping member, adjusting member) configuration may be changed to tailor the horizontal and vertical forces that secure (e.g., clamp) the pedestal of the toilet to the trap.

The clamping member 32 having a cone shaped third opening 42 may allow the normal force Fn to be distributed over the length of the top surface 42*a* of the third opening 42, as well as over the length of the adjusting member 34 contacting the clamping member 32. This distribution of the force allows the configuration of the coupling assembly 30 (e.g., the clamping member 32, adjusting member 34) to be optimally configured (e.g., thickness, material, cost, etc.) to provide increased clamping force with an improved longevity. For example, a clamping member may be configured to have a point contact or a line of contact, as opposed to a surface of contact, with the adjusting member, which concentrates the force to the point or line, and may accordingly require a change in design, such as in material to increase the mechanical properties, to accommodate the stress concentration that results. The distribution of force (or pressure) ameliorates the issues associated with stress concentrations.

According to an exemplary embodiment, the trap of the toilet may be configured to accommodate varying width toilets. Accordingly, the same trap may be used to couple more than one model of toilet with each toilet having different widths (e.g., distance between the walls of the pedestal such as the distance between 22*a* and 22*b* shown in FIG. 5). In order to accommodate varying widths of the pedestals, the trap may be configured to include one or a plurality of openings (e.g., holes) configured in one or a plurality of ribs (e.g., walls) that extend from the base of the trap. The trap may also be configured to include a plurality of ribs, with each rib having one or a plurality of openings that align with one or more openings provided on other ribs.

Figure 15:
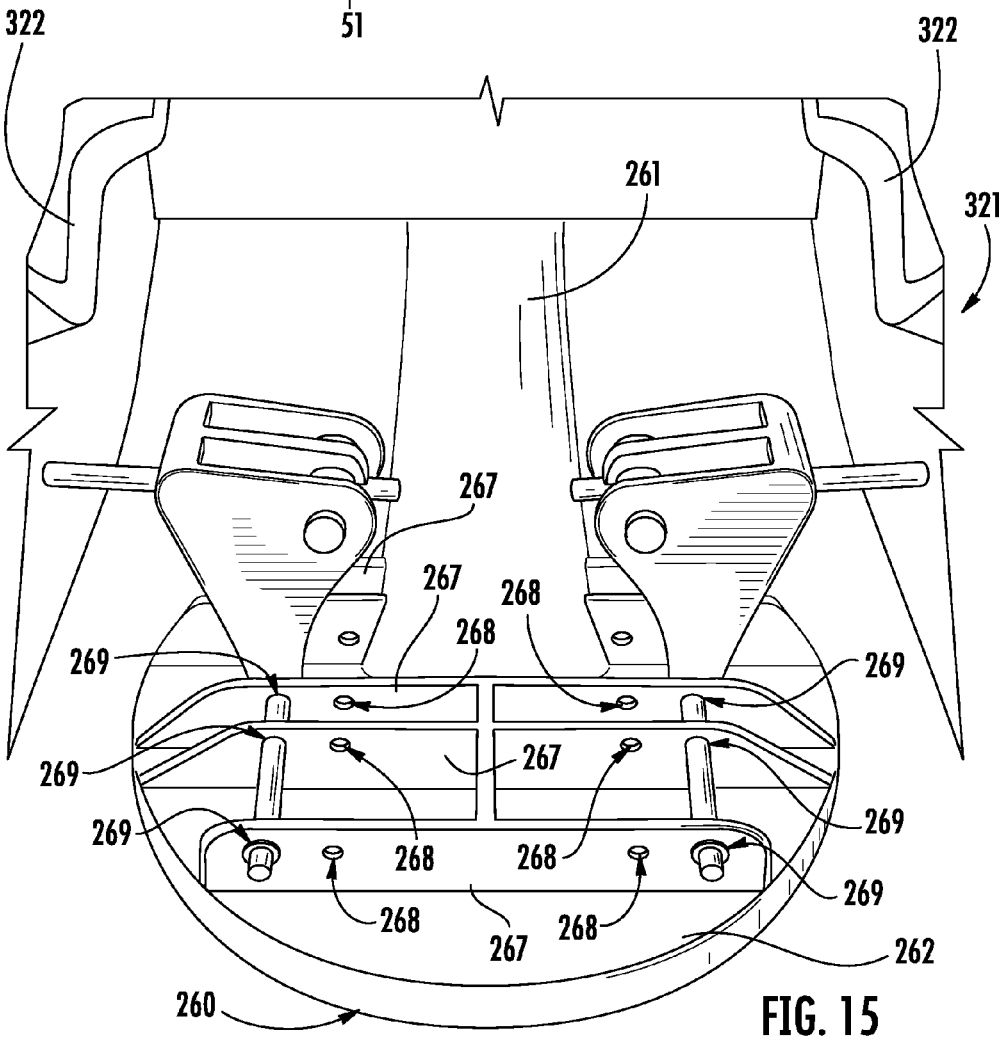
FIG. 15 is a perspective view illustrating a coupling or mounting assembly coupling a pedestal having a wider base to a trap.
Figure 16:
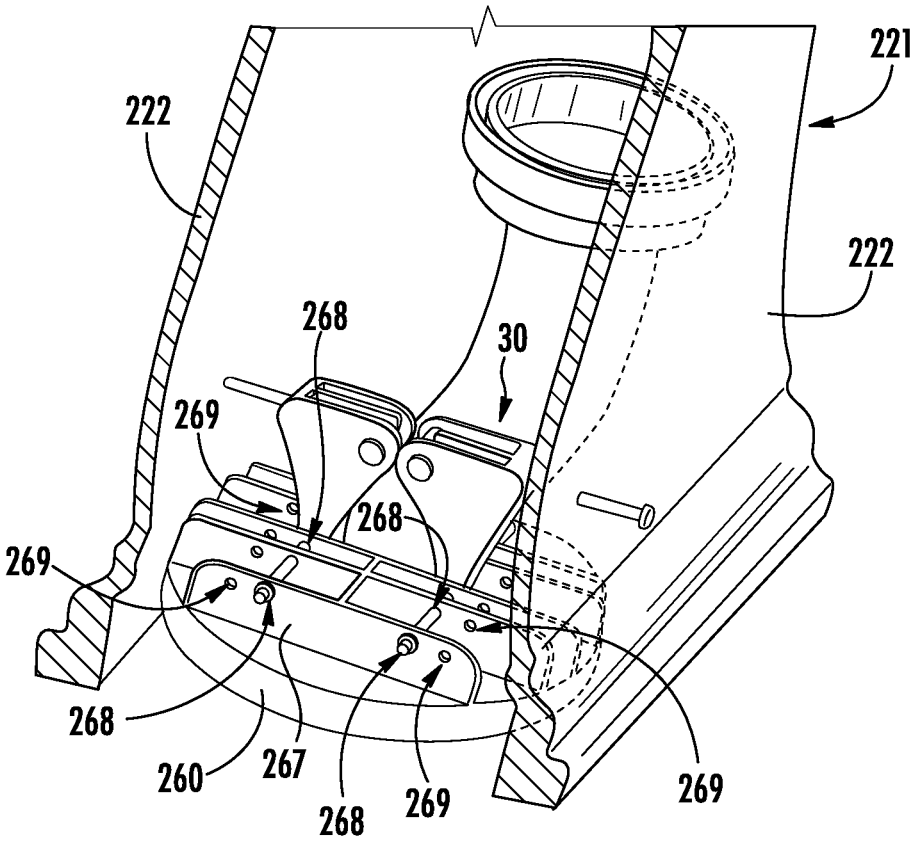
FIG. 16 is a perspective view illustrating a coupling or mounting assembly coupling a pedestal having a narrower base to a trap.
Figure 17:
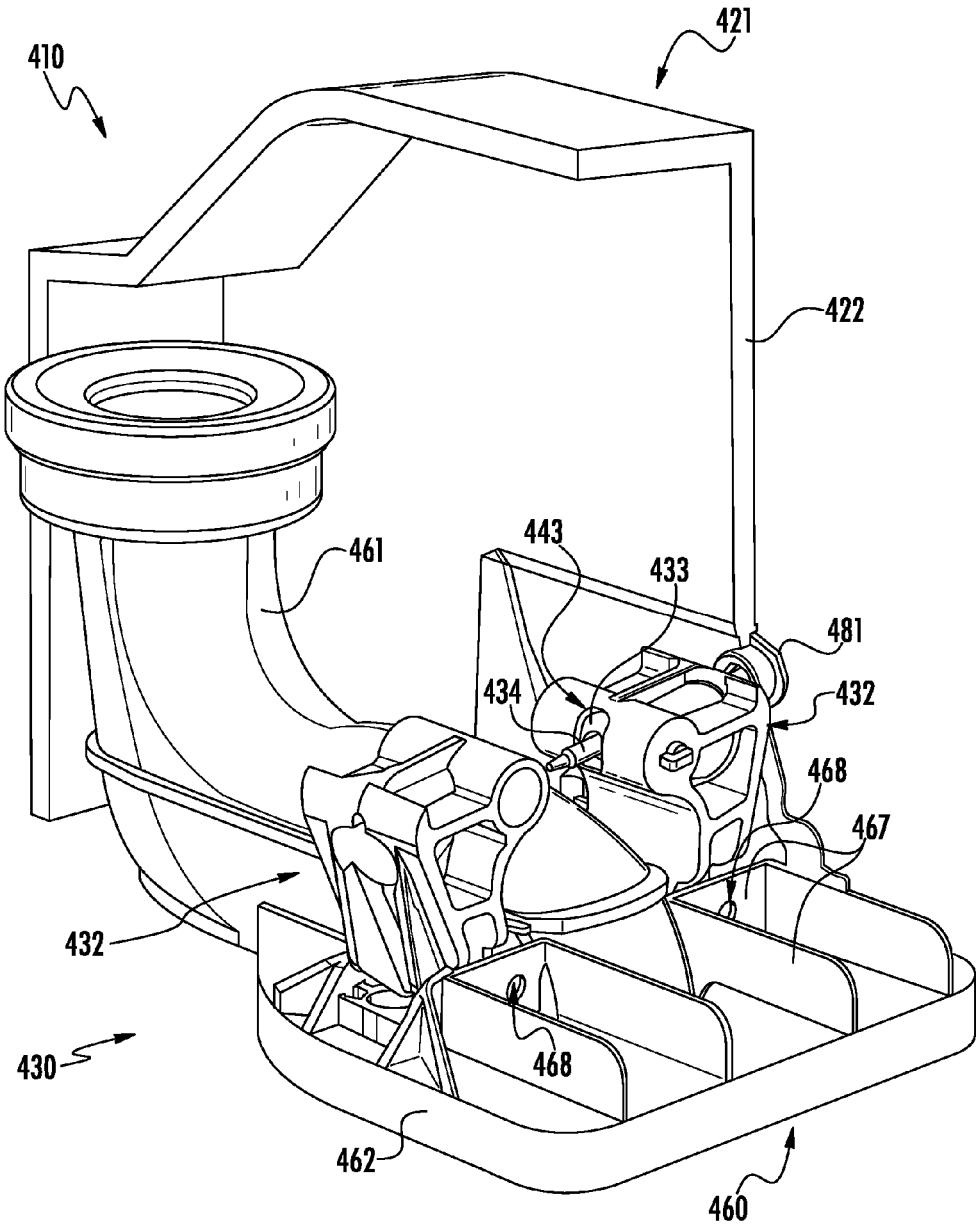
FIG. 17 is a side perspective view of another exemplary embodiment of a coupling or mounting assembly shown coupling the pedestal of the toilet to a trap.
Figure 18:
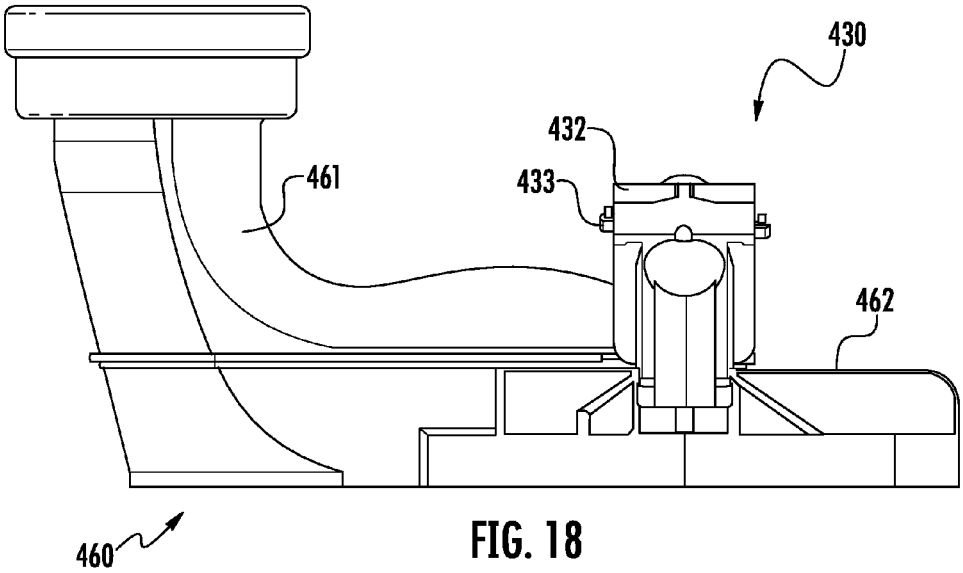
FIG. 18 is a side view of the coupling assembly of FIG. 17 shown coupled to a trap.
Figure 19:
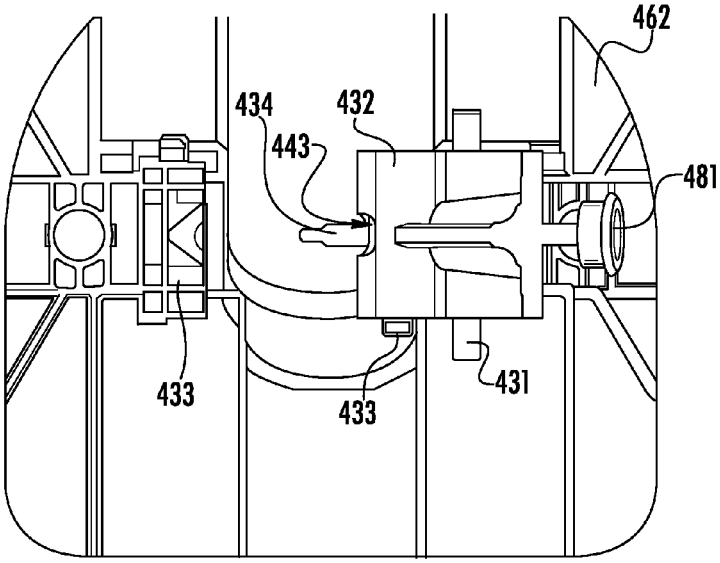
FIG. 19 is a top view of the coupling assembly of FIG. 17 shown coupled to a trap.
Figure 20:
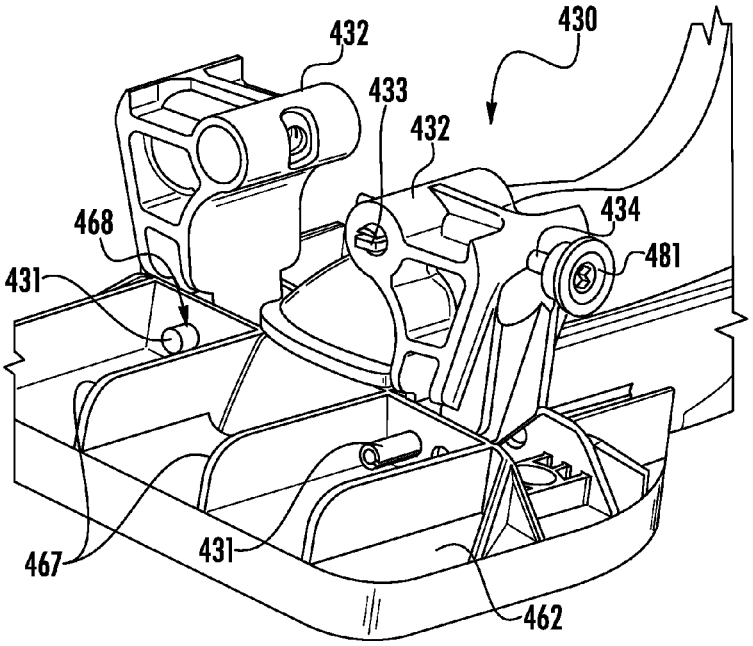
FIG. 20 is a perspective view of a portion of the coupling assembly of FIG. 17 shown coupled to a trap.
Figure 21:
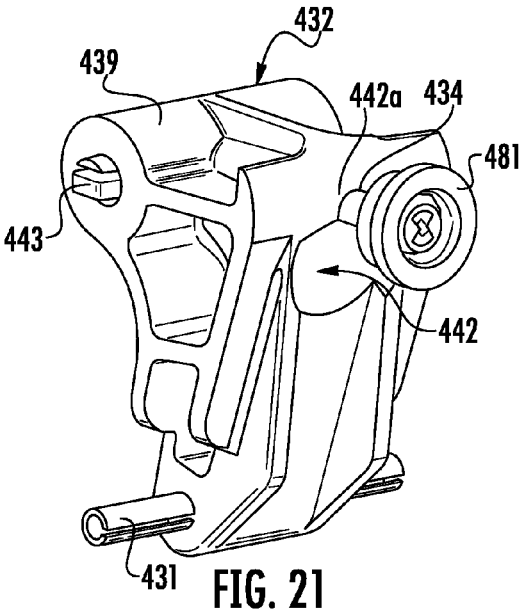
FIG. 21 is another perspective view of a portion of the coupling assembly of FIG. 17.
Figure 22:
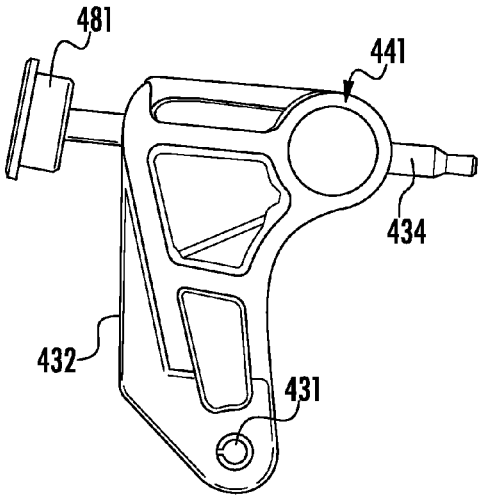
FIG. 22 is a front view of the portion of the coupling assembly of FIG. 21.
Figure 23:
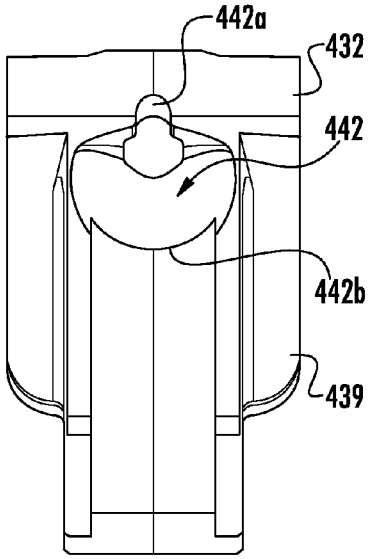
FIG. 23 is a side view of another exemplary embodiment of a clamping member.
Figure 24:
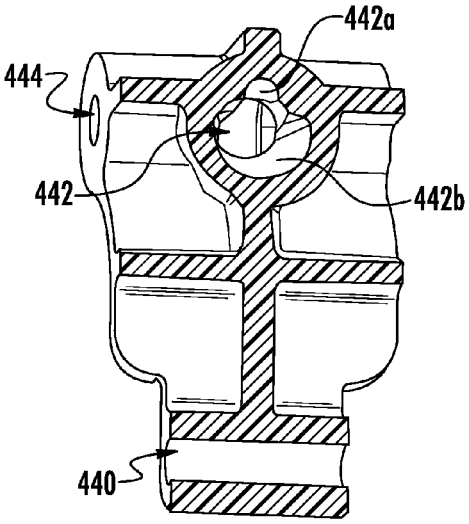
FIG. 24 is a sectional view of the clamping member of FIG. 23.

According to an exemplary embodiment shown in FIGS. 15 and 16, the trap 260 may include a trap passageway 261 extending from a base 262, wherein the base 262 is configured to include a plurality of ribs 267 with each rib 267 having a first (or inner) set of holes 268 and a second (or outer) set of holes 269. As shown in FIG. 16, the first (or inner) set of holes 268 may be used to couple a toilet having a pedestal 221 that is narrow (i.e., the distance between the walls 222 is relatively small) through a coupling assembly 30. As shown in FIG. 15, the second (or outer) set of holes 269 may be used to couple a toilet having a pedestal 321 that is wide (i.e., the distance between the walls 322 is relatively large) through a coupling assembly 30. It should be noted that the trap may include any number of sets of holes (e.g., openings) to provide coupling of any width toilet to the trap and/or the soil pipe through the coupling assembly 30, and the embodiments disclosed herein are not meant as limitations.

FIGS. 17-20 illustrate another exemplary embodiment of a mounting or coupling assembly 430 configured to secure the pedestal 421 of the toilet 410 to the trap 460. As shown, two coupling assemblies 430 are provided on opposing sides of the trap 460 in order to secure two opposing side walls 422 to the trap 460 and/or to the floor. The trap 460 may be configured the same as, similar to, or different from the other traps (e.g., the trap 60, the trap 260) disclosed herein. For example, the trap 460 may include a base 462 and a passageway 461 that extends from the base 462 and is in fluid communication with the toilet 410, such as with the bowl through a trapway. The base 462 may include a plurality of ribs 467, where each rib 467 has one or more than one hole 468 provided therein. For example, each hole 468 may receive the pin 431 in which the clamping member 432 is configured to pivot about.

As shown, each coupling assembly 430 includes a pin 431 configured to engage the base 462, a clamping member 432 pivotally coupled to the pin 431, a pivot member 433, and an adjusting member 434. The pivot member 433 may be disposed in a cavity of the clamping member 432, such that the clamping member 432 retains the pivot member 433, yet the pivot member 433 is free to rotate in the cavity relative to clamping member 432. The adjusting member 434 is configured to engage the pivot member 433, such that the adjusting member 434 is adjustably restrained by the pivot member 433.

FIGS. 21-26 illustrate another exemplary embodiment of a clamping member 432. The clamping member 432 may be configured generally as described herein for other clamping members (e.g., the clamping member 32). The clamping member 432 may include a body 439 defining a cavity 445 and having a plurality of openings or holes provided therein. For example, the clamping member 432 may include a first opening 440 configured to receive the pin 431 and a second opening 441 configured to allow the pivot member 433 to be inserted into the cavity 445 through the second opening 441 to be retained in the cavity 445. The clamping member 432 may also include a third opening 442, a fourth opening 443, and/or a fifth opening 444.

The third opening 442 of the clamping member 432 may be configured having any suitable shape that may receive the adjusting member 434 therein. For example, the third opening 442 may have a generally conical shape that is defined by a surface with a slot provided therein. As shown, the slot may be defined by a curved upper surface 442*a* and the conical portion of the third opening 442 may be defined by a surface 442*b*. The slot may be configured with side walls that extend generally downward from the ends of the curved upper surface 442*a* to define an elongated slot. The width of the slot of the third opening 442 may be configured to receive the shank 434*a* of the adjusting member 434 therein, such as when the coupling assembly 430 is securing the pedestal 421 to the fixture (e.g., drain pipe, floor, etc.). This arrangement may capture the shank 434*a* in the slot and therefore support the shank 434*a* on multiple sides thereby reducing the degrees of freedom between the adjusting member 434 and the clamping member 432. This arrangement may advantageously increase the amount of lock-up to provide a stronger connection by the coupling assembly 430 to the pedestal 421 and the fixture. In other words, this arrangement may advantageously reduce the likelihood of movement (e.g., lateral, fore-aft) of the pedestal 421, such as the nose of the pedestal during use of the toilet, after being secured to the fixture.

The fourth opening 443 of the clamping member 432 may be provided on a side of the body 439 opposing the third opening 442, where the fourth opening 443 allows for the shank 434*a* of the adjusting member 434 to pass through, such as during adjustment of the adjusting member 434 to secure the pedestal 421 of the toilet 410 to the fixture. Accordingly, the fourth opening 443 may have any suitable shape and size, which may be tailored to the shape and size of the shank 434*a* along with any necessary clearance to accommodate the relative movement between the clamping member 432 and the adjusting member 434.

The fifth opening 444 of the clamping member 432 may be provided on a side of the body 439 opposing the second opening 441, such as to allow a portion (e.g., an end portion) of the pivot member 433 to pass through the fifth opening 444. The fifth opening 444 may have any suitable shape and size. As shown, the fifth opening 444 is configured as a generally round opening having a diameter that is smaller than the diameter of the second opening 441. This may advantageously allow the pivot member 433 to be inserted into the cavity 445 through the second opening 441, such that the fifth opening 444 receives a locking end of the pivot member 433 to allow relative rotation between the pivot member 433 and the clamping member 432 about a pivot axis, while preventing displacement of the pivot member 433 relative to the clamping member 432 along the pivot axis.

Figure 25:
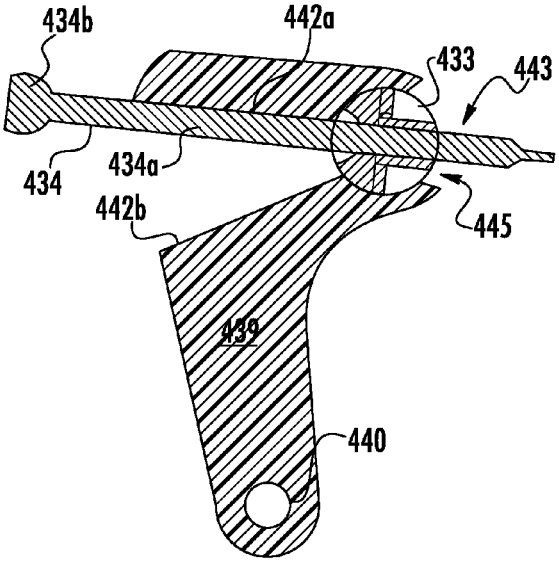
FIG. 25 is a sectional of the portion of the coupling assembly of FIG. 21.
Figure 26:
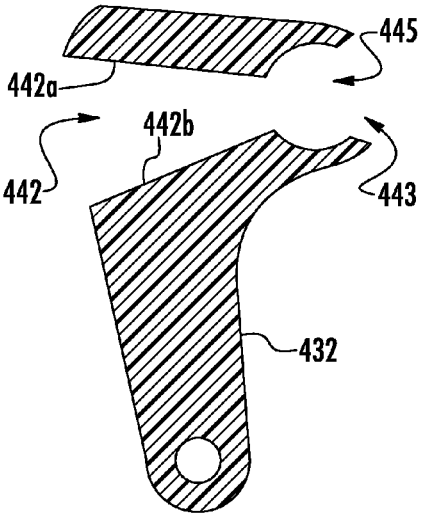
FIG. 26 is another sectional view of the clamping member of FIG. 23.
Figure 28:
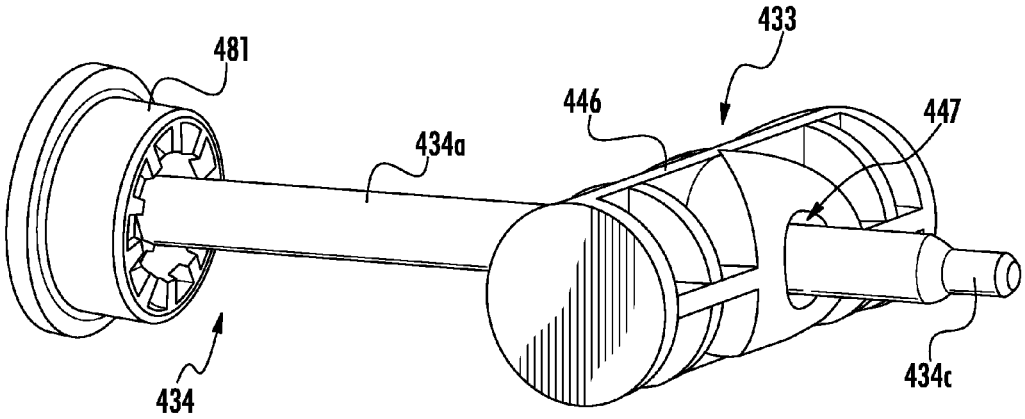
FIG. 28 is a perspective view of the adjusting member and pivot member of FIG. 27.

The pivot member 433 may be configured generally as described herein for other pivot members (e.g., the pivot member 33). The pivot member 433 is configured to be pivotally coupled to the clamping member 432. The pivot member 433 may have any suitable shape and size. As shown in FIGS. 25 and 28, the pivot member 433 includes a cylindrical body 446 that is configured to be disposed in the cavity 445 of the clamping member 432, where the outside surface of the body 446 acts as a bearing surface during relative rotation between the pivot member 433 and the clamping member 432. The cylindrical body 446 may define a pivot axis for the pivot member 433 to rotate about relative to the clamping member 432. The size (e.g., outer diameter) of the body 446 may be tailored to pass through the second opening 441 of the clamping member 432.

Figure 27:
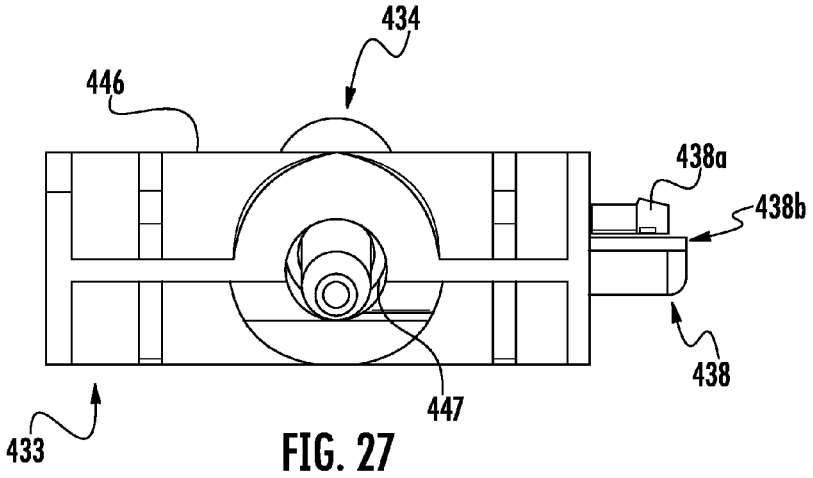
FIG. 27 is a side view of an adjusting member engaging a pivot member, according to another exemplary embodiment.

The pivot member 433 may also include a locking feature configured to pivotally couple the pivot member 433 to the clamping member 432. As shown in FIG. 27, the locking feature is configured as a generally cylindrical snap 438 having a detent 438*a*, which may be configured to pass through the fifth opening 444 and to engage an outer surface of the body 439 of the clamping member 432, such as to prevent relative lateral movement (e.g., along the pivot axis) between the pivot member 433 and clamping member 432. The detent 438*a* may have an outer size (e.g., diameter) that is configured to be larger than the fifth opening 444 of the clamping member 432 to provide an interference fit while passing therethrough, yet the detent 438*a* may be flexible to allow it to deform during assembly, then return to its natural (e.g., pre-deformed) state to pivotally couple the pivot member 433 to the clamping member 432. The snap 438 may also have a notch 438*b* (e.g., channel, slot, groove, etc.) that may generally divide the snap 438 into two portions. The notch 438*b* is configured to allow the detent 438*a* to flex along with the portion on which the detent 438*a* is disposed, such as during assembly.

The pivot member 433 includes a feature to adjustably couple the adjusting member 434 to the pivot member 433. For example, the body 446 of the pivot member 433 includes an internal threaded opening 447 that is configured to receive mating external threads of the shank 434*a* of the adjusting member 434. However, it should be noted that the pivot member 433 may include any suitable feature that couples (e.g., adjustably couples) the adjusting member 434 to the pivot member 433.

As shown in FIGS. 25, 27, and 28, the adjusting member 434 includes a shank 434*a* and a head 434*b*. The shank 434*a* has a first end and a second end, where the first end of the shank 434*a* is configured to pass through the clamping member 432 (e.g., the third opening 442), such as to engage the pivot member 433. The second end of the shank 434*a* is configured to engage the head 434*b* of the adjusting member 434. The head 434*b* may pivot (i.e., has some rotational freedom) relative to another member, such as a bushing or end cap, to allow for the alignment of the shank 434*a* to be varied. This arrangement may advantageously improve assembly, such as by allowing the head 434*b* to maintain a relatively fixed position that is retained by the bushing for the installer to manipulate, while allowing the alignment (e.g., the angle of insertion) of the shank 434*a* to be varied to properly engage the pivot member 433.

The shank 434*a* may also include a lead-in feature to help facilitate coupling the adjusting member 434 to the pivot member 433, such as during installation of the pedestal to the fixture. As shown in FIG. 28, the lead-in feature is configured as shoulder 434*c* having a smaller diameter relative to the diameter of the shank 434*a*. However, the lead-in may have any suitable configuration (e.g., size, shape), such as being a tapered portion extending from the shank 434*a*.

The coupling assembly 430 may also include a connecting feature that is configured to retain the head 434*b* of the adjusting member 434 with respect to the opening 28 in the wall 22 of the pedestal 21. As shown, the connecting feature is configured as a bushing 481 having a body that is configured to engage the opening 28 in the wall 22 and a head that is configured to abut the outer surface of the wall 22. In other words, the body of the bushing 481 acts as a bearing surface (although not necessarily for pivoting purposes) to distribute loading from the adjusting member 434 to the pedestal 21 through the contact surface of the wall 22, and the head of the bushing 481 limits movement of the bushing 481 (and the adjusting member 434) in the direction toward the wall 22. The bushing 481 may include a recess that is configured to receive the adjusting member 434, such as the head 434*b* of the adjusting member 434, to retain the coupled adjusting member 434 and bushing 481 to the wall 22 of the pedestal 21. For example, the recess of the bushing 481 may be configured so that there is an interference fit between the head 434*b* and the inner surface of the body of the bushing 481, such that once the head 434*b* is pressed into place into the recess, the inner surface of the body prohibits the head 434*b* from passing back out of the recess.

The head 434*b* of the adjusting member 434 may be configured to have a diameter that is larger than the diameter of the opening 28 in the wall 22 of the pedestal 21 and/or that is larger than an inner diameter of the body of the bushing 481, so that the adjusting member 434 may impart clamp forces (e.g., horizontal forces, vertical forces) into the wall 22 directly or indirectly through the bushing 481. For example, once the coupling assembly 430 is installed to secure the pedestal 21 to the trap and floor, adjustment (e.g., rotation) of the adjusting member 434 is configured to move the pivot member 433 along the shank 434*a* of the adjusting member 434, where the movement of the pivot member 433 in turn pivots the clamping member 432 relative to the trap 460. The clamping member 432 may pivot between a first position in which a portion (e.g., the upper surface 442*a*) of the clamping member 432 contacts the adjusting member 434 (e.g., to thereby load the shank 434*a*) to secure the pedestal 421 to the trap 460 and a second position in which the portion of the clamping member 432 does not contact the adjusting member 434.

When the clamping member is in the first position and the upper surface 442*a* of the clamping member 432 contacts the adjusting member 434, a normal force Fn is imparted from the clamping member 432 to the adjusting member 434, which is transferred through the adjusting member 434 and/or the bushing 481 to the wall 22 of the pedestal 21. The normal force Fn acts to secure (e.g., clamp) the pedestal to the trap and/or floor. The normal force Fn may be varied by adjustment of the adjusting member 434, such as to increase the clamping force between the pedestal 21 and the trap and/or floor. When the clamping member 432 contacts the adjusting member 434, this contact acts to prohibit additional pivoting of the clamping member 432, which in turn acts to maintain the relative position or location of the pivot member 433. This arrangement induces an axial force Fa that is directed along the longitudinal axis of the shank 434*a* of the adjusting member 434. Accordingly, additional adjustment of the adjusting member 434 in the tightening direction increases the axial force Fa since the relative position of the pivot member 433 is restrained (e.g., relatively fixed) and the threaded engagement between the adjusting member 434 and pivot member 433 moves the pivot member 433 along the adjusting member 433. In other words, since the head 434*b* of the adjusting member 434 is fixed (e.g., in the lateral direction) by the wall 22 and/or the bushing 481 and the pivot member 433 is relatively fixed due to the contact between the clamping member 432 and the adjusting member 433, an increasing tension force in the shank 434*a* is induced by additional adjustment (e.g., tightening) that increases the axial force Fa. The axial force Fa is transferred to the wall 22 to secure the pedestal 21 in the lateral direction, while the normal force Fn is transferred to the wall 22 to secure the pedestal 21 in the vertical direction.

Additionally, the toilets having coupling assemblies disclosed herein may be configured to couple the trap and/or soil pipe to the toilets having varying offset distances (i.e., the distance between the passageway of the soil pipe and the rear wall provided behind the toilet of the washroom). For example, some toilets are configured to have a ten inch (10 in.) offset distance, having approximately ten inches in length between the centerline of the passageway of the soil pipe and the rear wall. Other toilets are configured to have twelve inch (12 in.) or fourteen inch (14 in.) offset distances. The coupling assemblies disclosed herein may be used to couple toilets to traps configured with any offset distance (e.g., 10 in., 12 in., 14 in., etc.). The coupling assemblies disclosed herein allow for the flexibility to couple any trap (e.g., 10 in., 12 in., 14 in.) to any toilet and allow for a single toilet model to couple these alternate soil pipe passageway offset distances.

As shown in FIGS. 7 and 8, the coupling assembly may also include a bearing device 81 provided in the wall of the of the pedestal of the toilet to provide a bearing surface that the adjusting member may rotate within. The bearing device 81 may also absorb loads that are induced by the adjusting member, such as loads that otherwise would be imparted into the surface of the opening of the wall of the pedestal.

As shown in FIGS. 7 and 8, the coupling assembly may also include a cap 83, which may be configured to surround the head of the adjusting member to improve the aesthetics. Accordingly, the aesthetic cap 83 may visually blend in with the wall of the pedestal, such as by having substantially the same color and/or texture as the wall, to thereby hide the head of the adjusting member, which may be configured having a color and/or texture that is dissimilar to the wall of the pedestal.

FIGS. 29-44 illustrate various other embodiments of installation or mounting assemblies (or coupling assemblies) configured to secure the toilet to the trap, soil pipe, and/or floor of the washroom. These embodiments are configured to apply clamping forces in both the horizontal and vertical directions. Additionally, the toilet may include one or more mounting assemblies. For example, the toilet may include two mounting assemblies, with one mounting assembly provided on each side of the trap, in order to more securely couple the toilet to the trap, soil pipe, and/or the floor.

Figure 29:
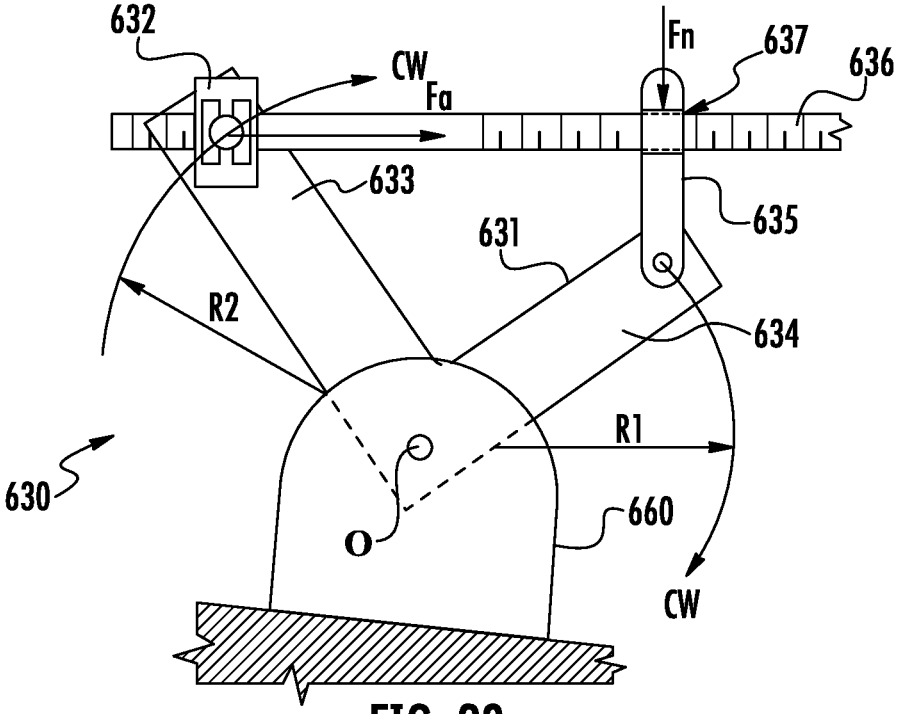
FIGS. 29-40B are other exemplary embodiments of coupling or mounting assemblies configured for use in toilets, such as to secure the pedestals of the toilets to soil pipes and/or floors.

As shown in FIG. 29, the mounting assembly 630 includes an L-shaped pivot arm 631 pivotally coupled to the trap 660 at pivot O, a threaded pivot 632 pivotally coupled to a first leg 633 of the pivot arm 631, a clamping member 635 pivotally coupled to a second leg 634 of the pivot arm 631, and an adjusting member 636 that passes through an opening in the clamping member 635 and threads into the threaded pivot 632. The threaded pivot 632 may rotate at a distance R2 from pivot O, while the clamping member 635 may rotate at a distance R1 from pivot O. When the adjusting member 636 is rotated in the tightening direction, the threads of the adjusting member 636 pull the threaded pivot 632 along the length of the adjusting member 636, thereby rotating the pivot arm 631 about pivot O in the direction CW, since the adjusting member 636 may include a head or shoulder that engages the wall (not shown) of the pedestal of the toilet (not shown, but may be provided to the right of the clamping member 635 in FIG. 29) to maintain the lateral position of the adjusting member 636. When the pivot arm 631 rotates it pulls the clamping member 635 downwardly inducing a normal force Fn onto the adjusting member 636 from the top surface of the opening 637 of the clamping member 635. Upon contact between the top surface of the opening 637 of the clamping member 635 and the adjusting member 636, an axial force Fa increases along the axis of the adjusting member 636 with increasing adjustment of the adjusting member 636 in the tightening direction.

Figure 30:
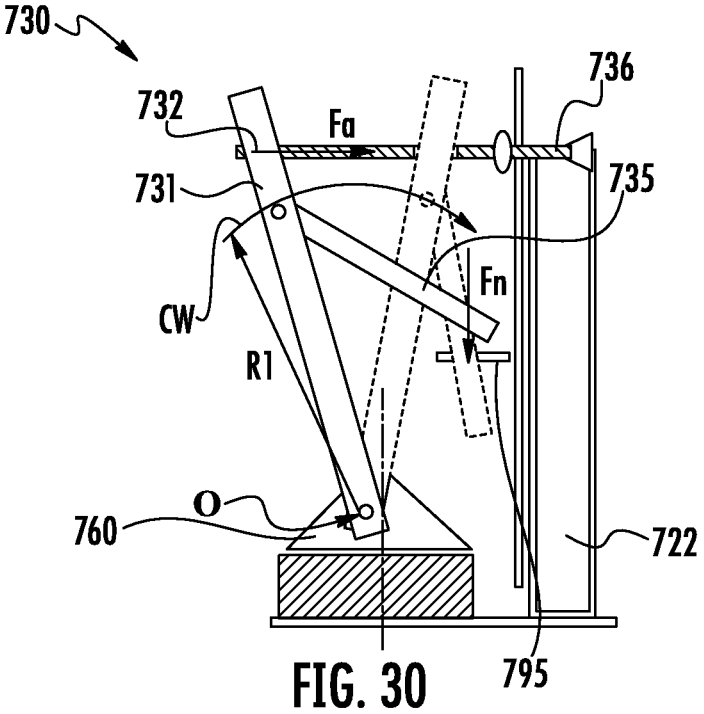
Figure 31:
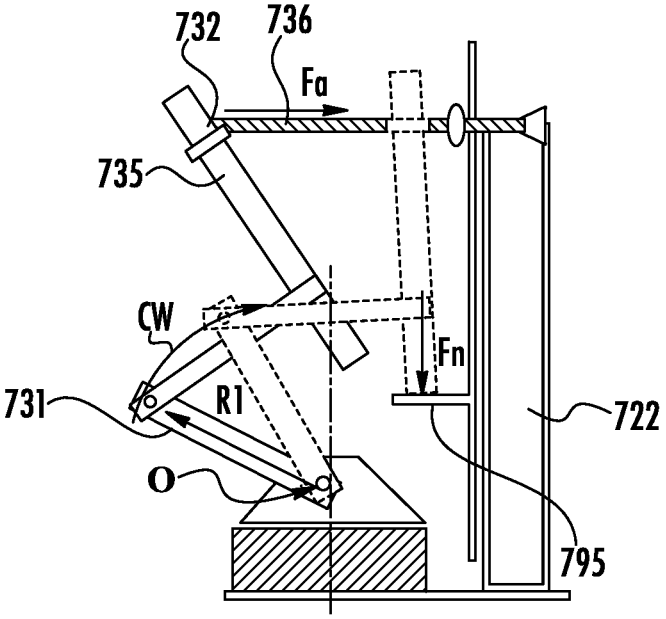
Figure 32:
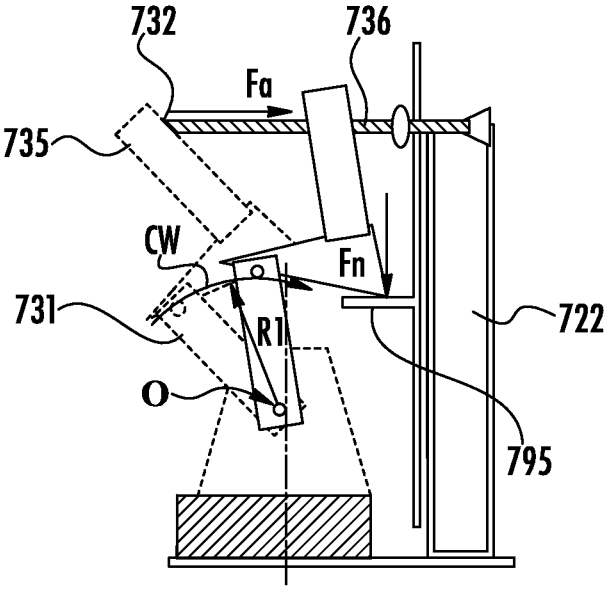

FIGS. 30-32 illustrate other mounting assemblies 730 that include pivot arms 731 configured to pivotally couple to a trap assembly 760 at a pivot O. The mounting assembly 730 may also include a clamping member 735 that is configured to impart a force Fn into a load member 795 of a wall 722 of a pedestal of the toilet when the pivot arm 731 is rotated, such as at a distance R1 from pivot O, and an adjusting member 736 for rotating the pivot arm 731 when adjusted, such as by rotation in a tightening direction CW. The adjusting members 736 may be retained laterally by the wall of the pedestal, such that adjustment of the adjusting member 736 influences both the force Fn and an axial force Fa along the axis of the adjusting member 736. For example, the adjusting member 736 may include a head configured to engage a feature (e.g., countersink, counterbore) in the opening of the wall of the pedestal to retain the adjusting member in the lateral direction when tightened. The mounting assembly 730 may also include a threaded pivot 732 pivotally coupling the pivot arm 731 to the adjusting member 736.

Figure 33:
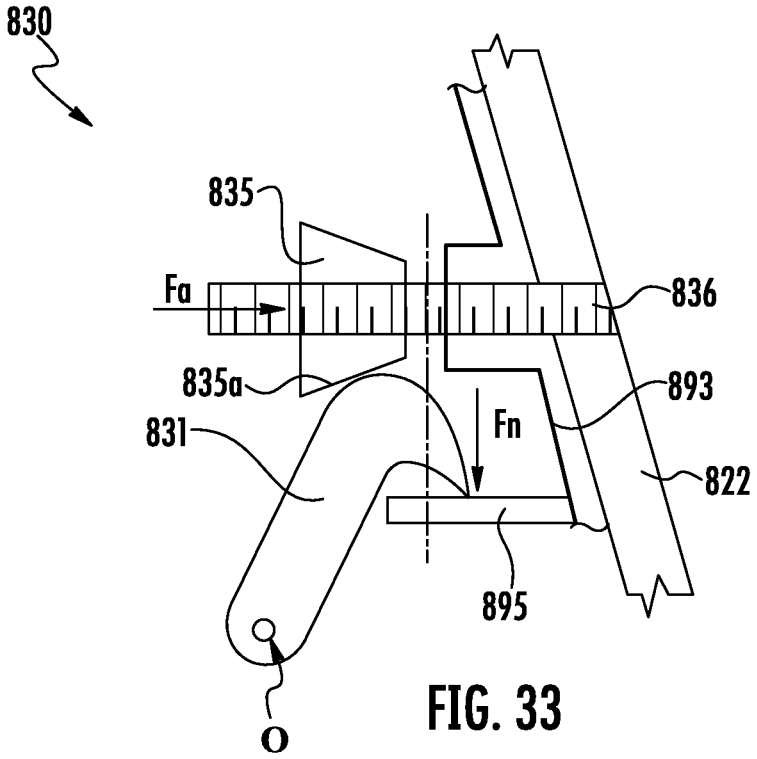
Figure 34:
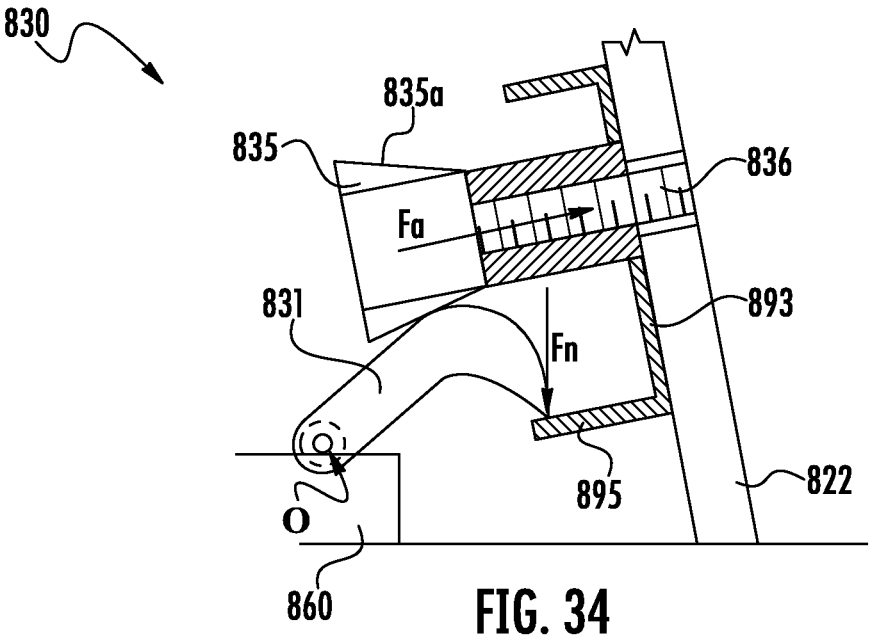
Figure 35:
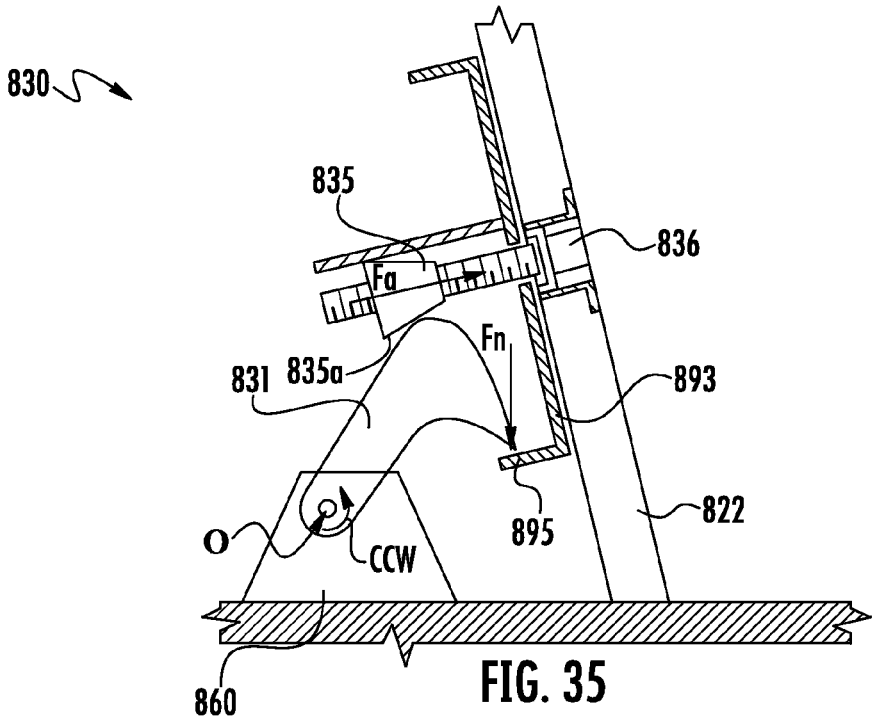

As shown in FIGS. 33-35, the mounting assemblies 830 may include a hook member (or pivot arm) 831 that is pivotally coupled to a trap 860 at a pivot O, a wedge (or cone) shaped clamping member 835, a guide 893 having a loading member 895, and an adjusting member 836. The guide 893 may be coupled to the inside of the wall 822 of the pedestal, such as by the adjusting member 836 or by another method. The adjusting member 836 may pass through an opening in the wall 822 of the pedestal to thread into the clamping member 835, wherein tightening of the adjusting member 836 may move (or pull) the clamping member 835 toward the wall 822 along the threads of the adjusting member 836. As the clamping member 835 moves toward the wall 822, the cone shaped outer surface of the clamping member 835 drives the hook member 831 to rotate about pivot O toward the loading member 895 of the guide 893 to thereby cause the hook member 831 to impart forces into the guide 893 (e.g., the loading member) to secure the wall 822 of the pedestal to the trap 860 through the hook member 831. The guide 893 may be configured as two C-clips or may have any suitable shape and/or configuration. The mounting assembly 830 may further include a spring or biasing member, such as to impart a biasing force on the hook member 831 in the non-loading direction CCW (or unclamping direction), as shown in FIG. 35.

Figure 36:
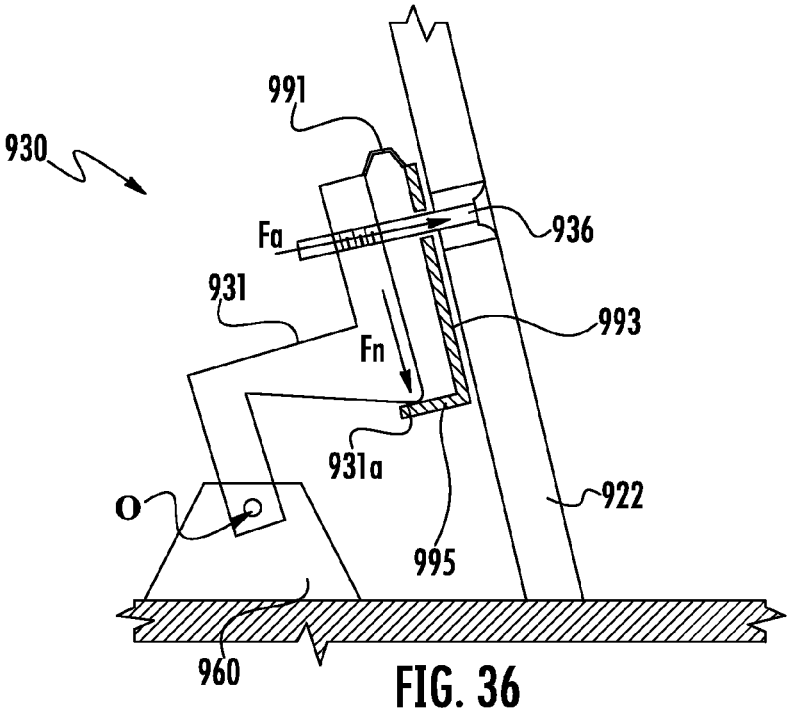

As shown in FIG. 36, the mounting assembly 930 may include a guide 993, an adjusting member 936, and a pivot arm 931 that is pivotally coupled to a trap assembly 960 at a pivot O, wherein the pivot arm 931 has a cam surface 931*a* (e.g., an eccentric surface relative to the pivot O of the pivot arm) configured to impart a clamping force Fn into the load member 995, which may be fixedly coupled to the wall 992 of the pedestal to transfer the force Fn from the guide 993 to the wall 992 in order to secure the pedestal in place. The load member 995 may be part of the guide 993, wherein the guide 993 may be formed separately from the pivot arm 931 or may be integrally formed with the pivot arm 931, such as by injection molding, wherein a hinge 991 (e.g., living hinge) may couple the pivot arm 931 and guide 993 but allow relative motion between the two. The guide 993 may include an opening configured to receive the adjusting member 936. The adjusting member 936 may include a head that may be retained by an opening (e.g., countersink) in the wall 922 and a threaded portion that may thread into a mating threaded portion of the pivot arm 931, wherein adjustment of the adjusting member 936 influences both the force Fn from the cam 931*a* into the load member 995 and the force Fa that is axial in the adjusting member 936 between the wall 922 and the pivot arm 931.

Figure 37:
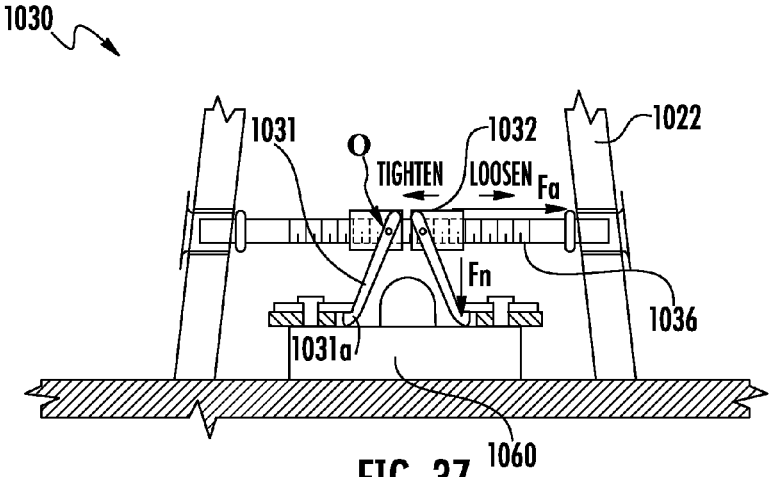
Figure 38A:
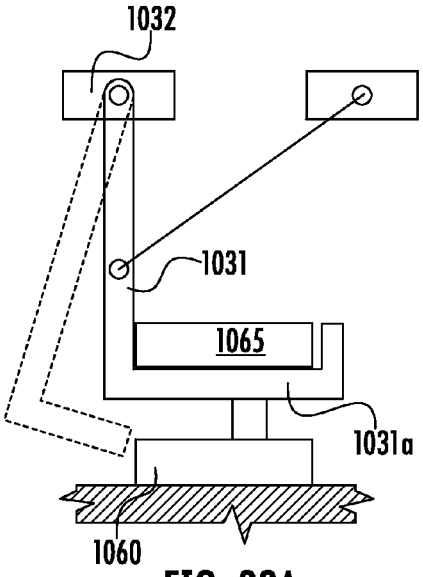
Figure 38B:
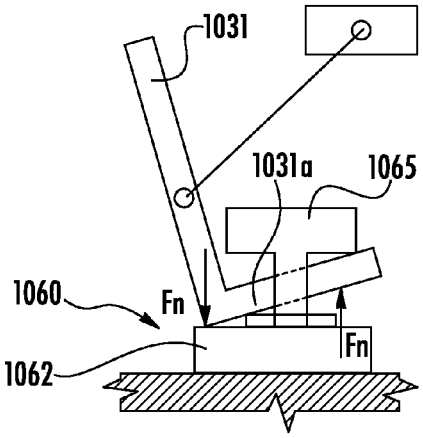

As shown in FIGS. 37-38B, the mounting assembly 1030 may be configured to include a jack-screw type mechanism. The mounting assembly 1030 may include a pivot arm 1031, an adjusting member 1036 having a threaded portion, and a threaded pivot 1032 pivotally coupled to the pivot arm 1031 at pivot O. The pivot arm 1031 may include a leg 1031*a* that is configured to impart a force Fn into the trap 1060 to secure the pedestal to the trap 1060 when the adjusting member 1036 is adjusted. The leg 1031*a* of the pivot arm 1031 may be configured to impart the force Fn into both an anchor 1065 and the base 1062 of the trap 1060, as shown in FIG. 38B. The threaded portion of the adjusting member 1036 may pass through an opening in the wall 1022 of the pedestal to thread into the threaded pivot 1032, wherein a head or shoulder of the adjusting member 1036 may contact a portion of the wall 1022 to prevent additional lateral motion of the adjusting member 1036. When the adjusting member 1036 is adjusted, the threaded portion may pull or push the threaded pivot 1032 along the length of the adjusting member 1036 to thereby tighten or loosen the pivot arm 1031 relative to the trap 1060. The translation or movement of the pivot O causes the pivot arm 1031 to pivot about O, which changes the alignment of the pivot arm 1031 with respect to the trap 1060 and anchor 1065 to influence the force Fn.

Figure 39:
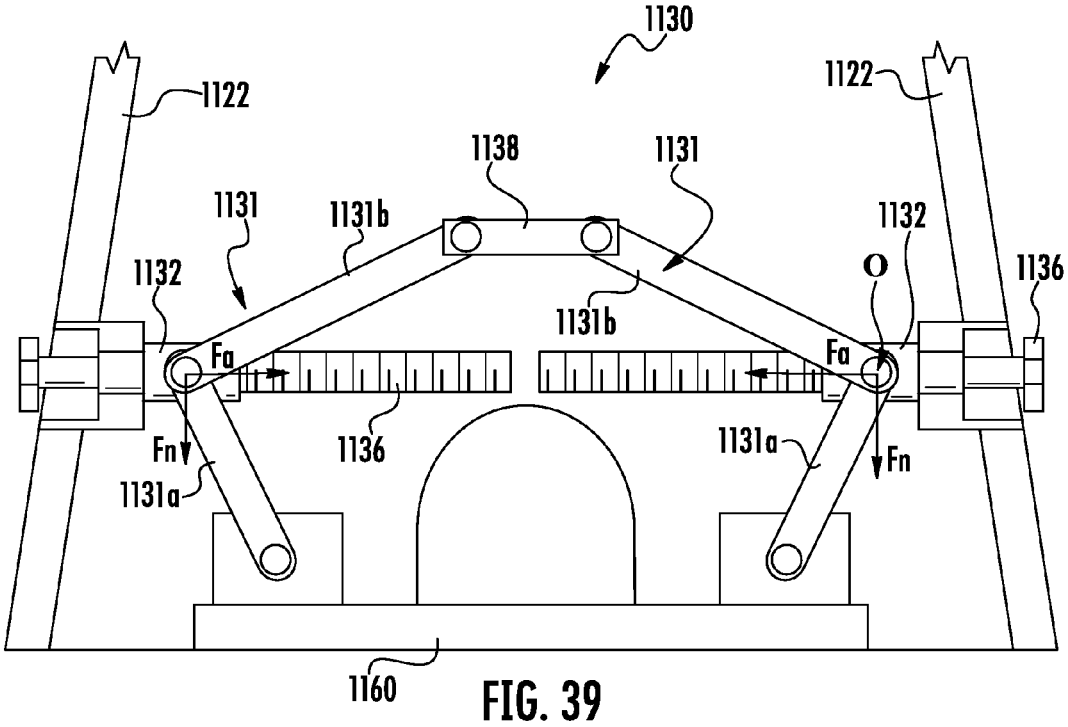

As shown in FIG. 39, the mounting assembly 1130 may be configured as a scissor-jack type mechanism. The mounting assembly 1130 may include a pivot arm 1131 having a first portion 1131*a* pivotally coupled to a second portion 1131*b*, such as through a threaded pivot 1132, wherein the first portion 1131*a* may also be coupled to the trap 1160 and the second portion 1131*b* may also be coupled to a link 1138. The mounting assembly 1130 may also include an adjusting member 1136 having a threaded portion that threads into the threaded pivot 1132, wherein adjustment (e.g., rotation) of the adjusting member 1136 moves (e.g., translates) the threaded pivot 1132 along the length of the adjusting member 1136 to influence the forces Fa and Fn that are configured to couple (e.g., secure) the pedestal to the trap 1160 (and/or soil pipe). It should be noted that although FIG. 39 shows the pivot arm 1131 having the first and second portions 1131*a*, 1131*b* directed outwardly (i.e., toward the wall 1122 of the pedestal), the mounting assembly 1130 may be configured with the first and second portions 1131*a*, 1131*b* of the pivot arm 1131 directed (e.g., pointing) inwardly (i.e., away from the walls 1122 toward the center of the trap 1160). Another mounting assembly may include a scissor-jack mechanism that couples to the trap and to the bottom-inside portion of the pedestal (or base), wherein the mounting assembly may be adjusted to more properly secure the pedestal (and the toilet) to the trap and/or the drain (or soil) pipe.

Figure 40A:
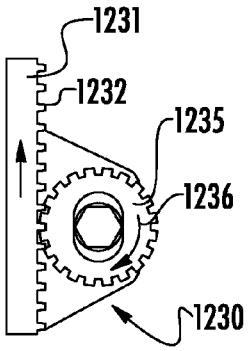
Figure 40B:
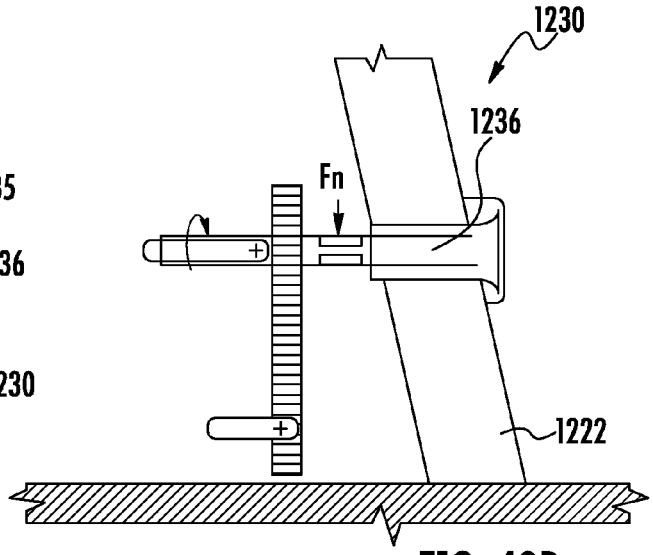

As shown in FIGS. 40A and 40B, the mounting assembly 1230 may be configured as a rack-and-pinion type mechanism. The mounting assembly 1230 may include a rack 1231 having an elongated portion configured with a set of gear teeth 1232 provided thereon and a pinion gear 1235 having a set of gear teeth 1236 provided along the outer surface (or profile) of the pinion 1235. The gear teeth 1236 of the pinion 1235 engage the gear teeth 1232 of the rack 1231 through a gear mesh, such that rotation of the pinion 1235 moves (e.g., translates) the rack 1231. The rack 1231 may be configured to be fixedly coupled to trap, and the pinion 1235 may be pivotally coupled to the wall 1222 of the pedestal, such that rotation of the pinion 1235 drives the rack 1231 to more securely couple the pedestal to the trap. The rack 1231 may also be configured to be coupled to the pedestal and the pinion 1235 coupled to the trap assembly. Other examples of rack-and-pinion type mounting assemblies may be configured to more properly secure the toilet to the trap, the soil pipe and/or the floor. The pinion may be remotely activated (e.g., rotated, manipulated) through the use of a cable system, or the cable system may be provided internally (i.e., between the walls of the pedestal) such that directly driving the pinion may pull on the cable coupled on the other end to the pedestal to influence the tension force in the cable, which provides the force to secure the pedestal of the toilet in place.

It should be noted that clamping members may have other various configurations, such as, for example, the clamping members may be A-shaped, rectangular shaped, triangular shaped, or may have any suitable shape. The clamping members may be used in coupling or mounting assemblies to more properly secure the toilet in place, such as through the use of an adjusting member.

The toilets disclosed herein having coupling assemblies are able to secure the toilet to the trap and drain pipe (or soil pipe) by applying clamping forces in both the horizontal and vertical directions, as opposed to just the horizontal direction or just the vertical direction. This provides a much more secure coupling between the toilet and the soil pipe and/or trap, which in addition to providing an improved retention of the toilet, provides stability to the toilet, such as during use thereof, and also improves the seal formed between the toilet and the soil pipe to reduce the likelihood of leaking through the seal.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilets and installation (or clamping or mounting) systems as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A method for installing a skirted toilet having a pedestal and a bowl, the method comprising:

securing a trap to a soil pipe, the trap having a base and a passageway configured to be fluidly connected between the bowl of the toilet and the soil pipe, wherein the base comprises a clamping member pivotally coupled thereto through a pin defining a horizontally extending pivot axis:

positioning the pedestal over the trap to fluidly couple the bowl to the trap such that an opening in a wall of the pedestal is substantially aligned with an opening in the clamping member; and securing the toilet to the trap by inserting an adjusting member through the opening of the pedestal and into the opening in the wall of the clamping member and rotating the adjusting member to pivot the clamping member into engagement with the adjusting member.

2. The method of claim 1, wherein the clamping member comprises a pivot member having threads configured to engage mating threads of the adjusting member, such that rotation of the adjusting member in a first direction pivots the clamping member to engage the adjusting member and rotation of the adjusting member in a second direction pivots the clamping member to disengage the adjusting member.

3. The method of claim 2, wherein rotation of the adjusting member in the first direction moves the pivot member along the adjusting member to thereby pivot the clamping member to engage the adjusting member, and wherein rotation of the adjusting member in the second direction moves the pivot member along the adjusting member to thereby pivot the clamping member to disengage the adjusting member.

4. The method of claim 1, further comprising a pivot member retained by the clamping member and configured to receive the adjusting member, wherein an adjustment of the adjusting member rotates the pivot member and the clamping member relative to one another about a second pivot axis, which is parallel to the pivot axis of the pin.

5. A method for installing a skirted toilet having a pedestal and a bowl the method comprising:

securing a trap to a soil pipe, the trap having a base and a passageway configured to be fluidly connected between the bowl of the toilet and the soil pipe, wherein the base comprises a First clamping member pivotally coupled thereto;

pivotally coupling a second clamping member to the base on an opposite side of the passageway relative to the first clamping member;

positioning the pedestal over the trap to fluidly couple the bowl to the trap such that a first opening in a wall of the pedestal is substantially aligned with an opening in the first clamping member;

securing the toilet to the trap by inserting a first adjusting member through the first opening of the pedestal and into the opening of the first clamping member and rotating the first adjusting member to pivot the first clamping member into engagement with the first adjusting member; and securing the toilet to the trap by inserting a second adjusting member, which is separate from the first adjusting member, through a second opening in the wall of the pedestal and into an opening of the second clamping member and rotating the second adjusting member to pivot the second clamping member into engagement with the second adjusting member.

6. The method of claim 5, wherein each clamping member comprises a pivot member having threads configured to engage mating threads of the associated first or second adjusting member, such that rotation of the associated first or second adjusting member in a first direction pivots the associated first or second clamping member to engage the associated first or second adjusting member and rotation of the associated first or second adjusting member in a second direction pivots the associated first or second clamping member to disengage the associated first or second adjusting member.

7. The method of claim 6, wherein each adjusting member can be adjusted independently of the other adjusting member.

8. The method of claim 5, wherein when each clamping member is in engagement with the associated first or second adjusting member, an axial force in a longitudinal direction of the associated first or second adjusting member and a normal force in a direction transverse to the axial force are induced to secure the pedestal to the trap.

9. A method for installing a skirted toilet base to a trap, the method comprising:

pivotally coupling first and second clamping members to first and second locations on the trap, such that each clamping member is rotatable relative to the trap; positioning the toilet base over the trap;

coupling a first adjusting member to the first clamping member through a first opening in the toilet base, such that adjustment or the first adjusting member relative to the first clamping member tightens or loosens the toilet base to the trap by rotating the first clamping member into or out of engagement with the first adjusting member; and coupling a second adjusting member, which is separate from the first adjusting member, to the second clamping member through a second opening in the toilet base, such that adjustment of the second adjusting member relative to the second clamping member tightens or loosens the toilet base to the trap by rotating the second damping member into or out of engagement with the second adjusting member.

10. The method of claim 9, wherein each damping member is rotatable relative to and independent from the rotation of the other damping member.

11. The method of claim 10, further comprising first and second pivot members, wherein each pivot member is associated with one of the first and second damping members and is configured to be coupled to the associated first or second adjusting member, such that adjustment of the associated first or second adjusting member induces relative movement between the adjusting member and the pivot member to thereby rotate the associated first or second damping member.

12. The method of claim 11, wherein each pivot member is pivotally coupled to the associated first or second clamping member, such that each pivot member can rotate relative to the associated first or second clamping member when the associated first or second adjusting member is adjusted.

13. The method of claim 9, wherein the first opening in the toilet base is in a first wall thereof, and wherein the second opening in the toilet base is in a second wall thereof.

14. The method of claim 13, wherein the first and second walls of the toilet base are provided on different sides of the trap.

15. The method of claim 13, wherein the first and second walls oppose one another.

16. A method for installing a skirted toilet base of a toilet having a bowl to a drain pipe configured to transfer waste and water, the method comprising:

coupling a base of a trap to the drain pipe such that a passageway of the trap is fluidly connected with the drain pipe, wherein a first clamping member is pivotally coupled to the trap and a second clamping member is pivotally coupled to the trap;

positioning the skirted toilet base over the trap such that the bowl is fluidly connected to the passageway;

coupling a first adjusting member to the first clamping member through a first opening in the skirted toilet base such that a portion of the first adjusting member contacts the skirted toilet base, wherein adjustment of the first adjusting member relative to the first clamping member tightens or loosens the skirted toilet base to the trap by rotating the first clamping member into or out of engagement with the first adjusting member; and coupling a second adjusting member to the second clamping member through a second opening in the skirted toilet base such that a portion of the second adjusting member contacts the skirted toilet base, wherein the second adjusting member is separate from the first adjusting member, and wherein each of the first and second adjusting members is adjustable independently of the other adjusting member.

17. The method of claim 16, wherein adjustment of the second adjusting member relative to the second clamping member tightens or loosens the skirted toilet base to the trap by rotating the second clamping member into or out of engagement with the second adjusting member.

18. The method of claim 17, wherein the first opening and the second opening in the skirted toilet base are provided on opposite walls of the skirted toilet base.

19. The method of claim 18, wherein each of the opposite walls of the skirted toilet base is a sidewall.

* * * * *